US007524002B2

(12) United States Patent
Punzel et al.

(10) Patent No.: US 7,524,002 B2
(45) Date of Patent: Apr. 28, 2009

(54) LOCKING DOOR SYSTEM FOR A STORAGE CABINET

(75) Inventors: William H Punzel, Fort Atkinson, WI (US); Jane E Glass, Fort Atkinson, WI (US); Andrew J. Kolman, Milton, WI (US); Steven S. Dingle, McFarland, WI (US); James C. Muth, Oconomowoc, WI (US)

(73) Assignee: Spacesaver Corporation, Fort Atkinson, WI (US)

( * ) Notice: Subject to any disclaimer, the term of this patent is extended or adjusted under 35 U.S.C. 154(b) by 0 days.

(21) Appl. No.: 11/585,069

(22) Filed: Oct. 23, 2006

(65) Prior Publication Data

US 2007/0278912 A1 Dec. 6, 2007

(51) Int. Cl.
*E05C 1/12* (2006.01)
*A47B 96/00* (2006.01)

(52) U.S. Cl. ..... 312/217; 312/215; 292/36

(58) Field of Classification Search ..... 211/61, 211/208, 4, 189, 207; 108/147.21; 42/106; 206/317; 312/216, 217, 322, 324, 351, 215, 312/222, 297; 292/36, DIG. 68, 34, 35, 159, 292/162, 42, DIG. 21, 148, 205; 49/395; 160/117, 118, 199, 206, 213; 70/212, 200, 70/203

See application file for complete search history.

(56) References Cited

U.S. PATENT DOCUMENTS 279,334 A * 6/1883 Clark ..... 292/36
1,438,233 A * 12/1922 Hammann ..... 292/5
1,600,140 A * 9/1926 Riepen ..... 292/36
1,811,312 A * 6/1931 Fildes ..... 160/117
2,584,089 A * 1/1952 Hillenbrand et al. ..... 312/213
2,658,101 A * 11/1953 Coxe, Jr. ..... 174/51
3,133,772 A * 5/1964 Brandes et al. ..... 312/108

(Continued)

FOREIGN PATENT DOCUMENTS

DE 4035150 5/1992

(Continued)

OTHER PUBLICATIONS

International Search Report dated May 20, 2005.

(Continued)

*Primary Examiner*—Janet M Wilkens
(74) *Attorney, Agent, or Firm*—Boyle Fredrickson, S.C.

(57) ABSTRACT

A storage cabinet assembly for use in storing firearms or the like includes a cabinet with a recessed bifold door arrangement, to facilitate access to items contained within the cabinet assembly. The door arrangement includes a single-point locking system, which provides a secure arrangement for maintaining the doors in a closed position while providing ease in opening and closing the doors. Various support and storage modules or components are adapted to be contained within the interior of the cabinet, including stock rests for positioning in the bottom of the cabinet interior, as well as barrel rests and pistol supports that are secured to amounting member which may be adjustably positioned within the storage cabinet interior. A bin or shelf arrangement may also be positioned within the storage cabinet interior. The various support and storage modules or components may be used in various combinations, and may be moved to various positions within the storage cabinet interior.

29 Claims, 22 Drawing Sheets

U.S. PATENT DOCUMENTS

| | | | | |
|---|---|---|---|---|
| 4,046,410 | A * | 9/1977 | Connell | 292/36 |
| 4,324,189 | A * | 4/1982 | Roldness | 105/378 |
| 4,348,069 | A | 9/1982 | Lindsay | |
| 4,461,385 | A | 7/1984 | Clouser | |
| 5,078,279 | A | 1/1992 | Hancock et al. | |
| 5,131,449 | A * | 7/1992 | Winn et al. | 160/199 |
| 5,265,950 | A | 11/1993 | Atkinson | |
| 6,056,376 | A * | 5/2000 | Yenglin et al. | 312/139.1 |
| 6,868,975 | B2 * | 3/2005 | Sells et al. | 211/4 |
| 6,971,686 | B2 * | 12/2005 | Becken | 292/39 |
| 7,322,661 | B1 * | 1/2008 | Salvesen | 312/322 |
| 2004/0045914 | A1 | 3/2004 | Sells et al. | |

FOREIGN PATENT DOCUMENTS

| | | |
|---|---|---|
| DE | 19541951 | 5/1997 |
| DE | 19700330 | 7/1997 |
| DE | 20103299 | 7/2001 |
| JP | 10153050 | 6/1998 |

OTHER PUBLICATIONS

Written Opinion of The International Searching Authority dated May 20, 2005.

International Preliminary Report On Patentability dated Oct. 1, 2005.

"Multitrack Multiple Weapons Storage Rack", U.S. Government, DSN 482-5860/5768, May 17, 2000, 18 pages.

* cited by examiner

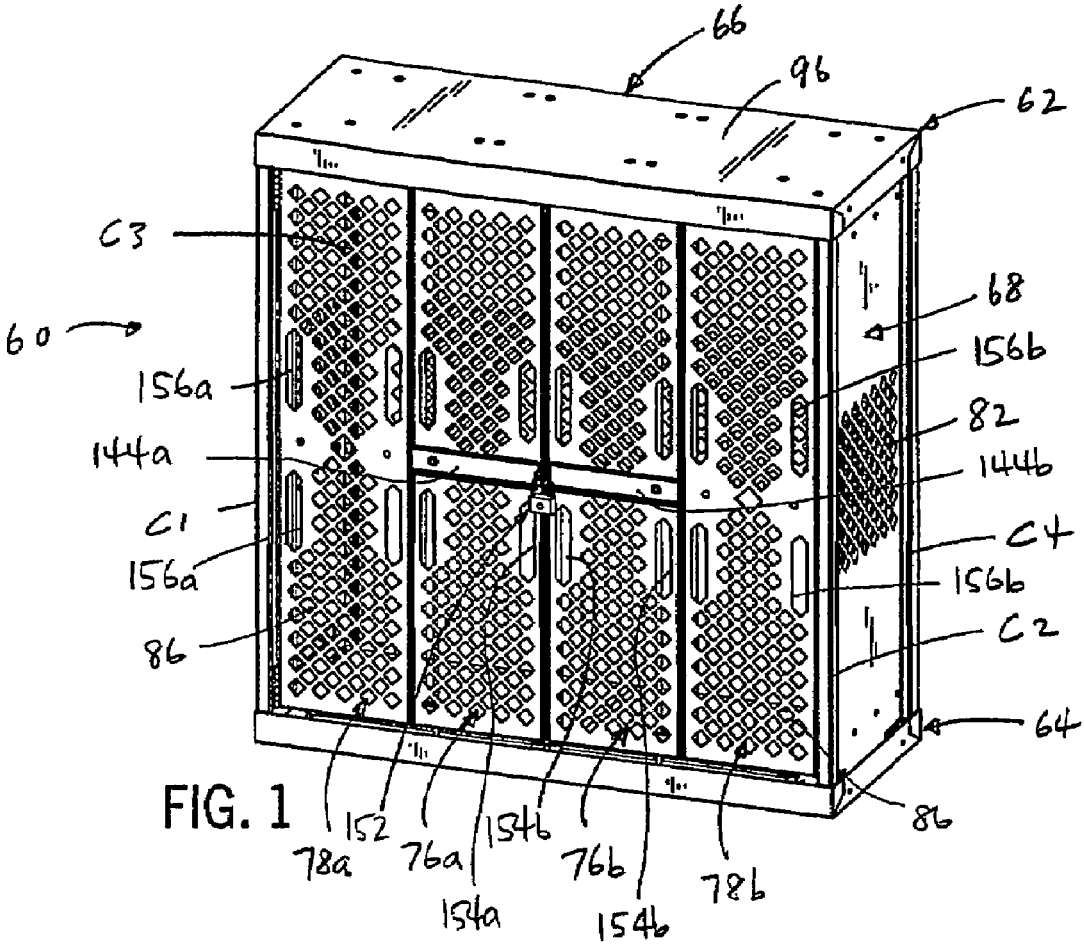
FIG. 1
FIG. 2
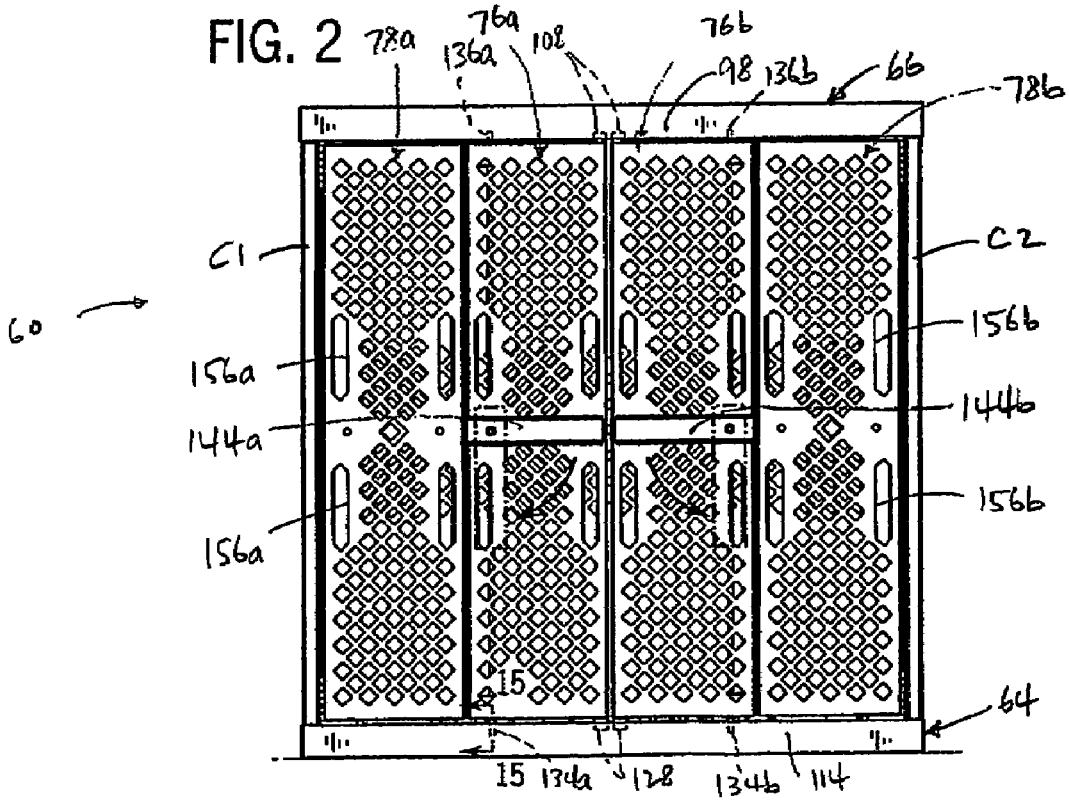

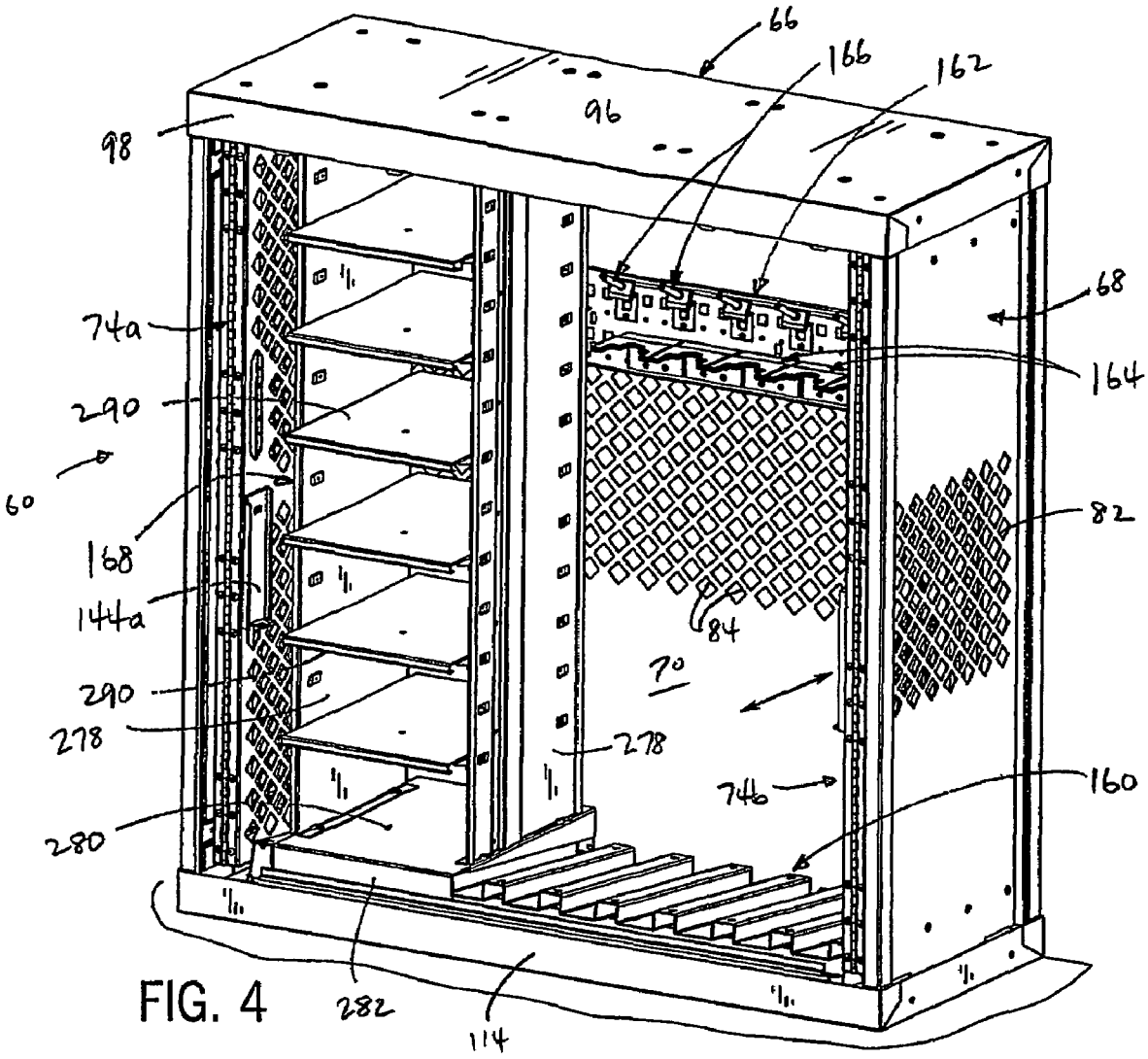
FIG. 4
FIG. 8
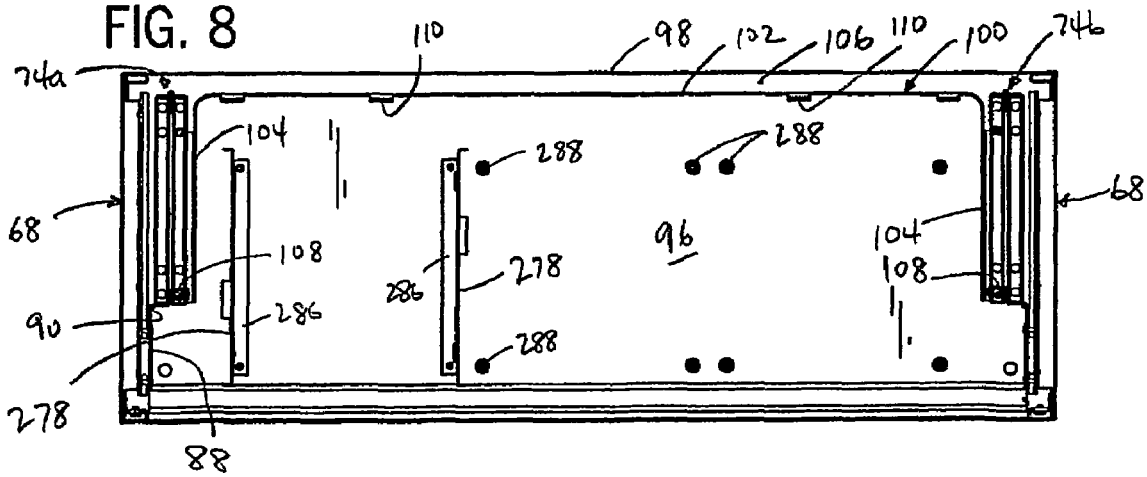

FIG. 23
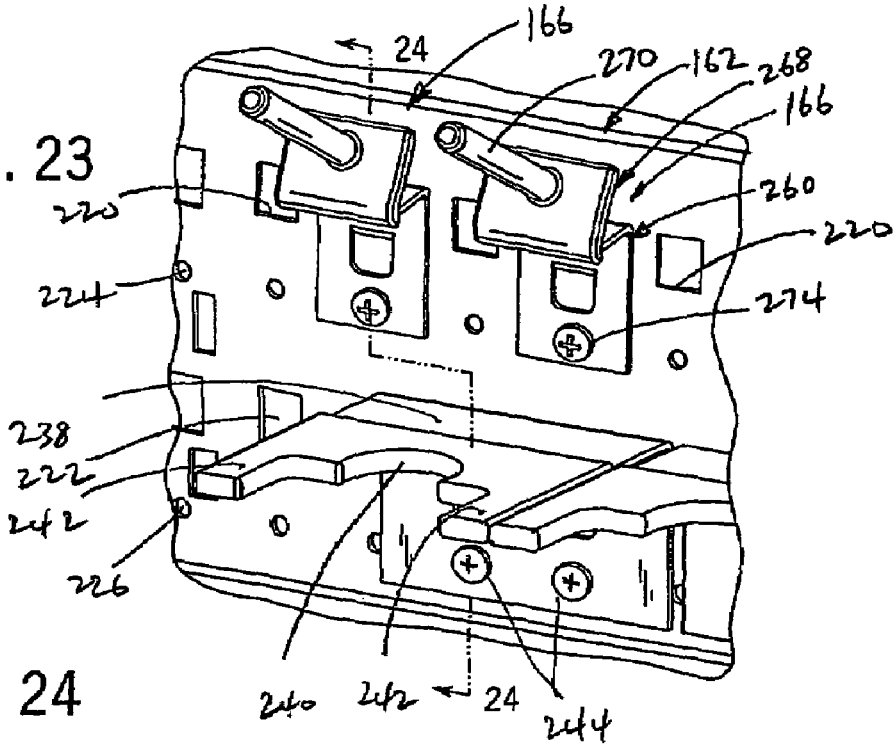
FIG. 24
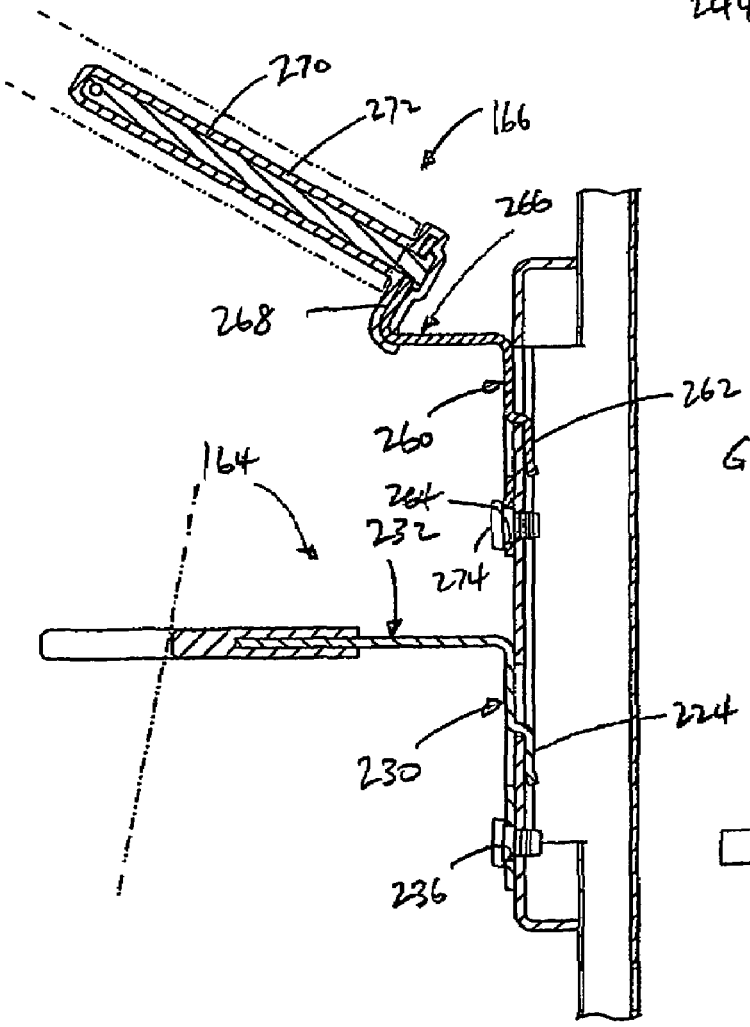
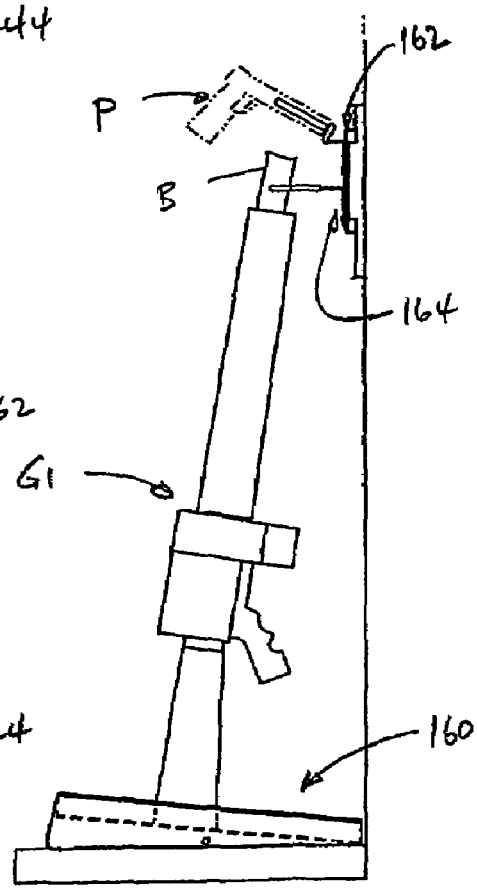
FIG. 25

LOCKING DOOR SYSTEM FOR A STORAGE CABINET

STATEMENT AS TO RIGHTS TO INVENTION MADE UNDER FEDERALLY-SPONSORED RESEARCH AND DEVELOPMENT

The invention was made with Government support under contract no. M67854-03-M-1017 awarded by the Marine Corps. The Government has certain rights in the invention.

CROSS-REFERENCE TO RELATED APPLICATION

This application claims the benefit of U.S. Provisional Application Ser. No. 60/457,231 filed Mar. 25, 2003.

BACKGROUND AND SUMMARY OF THE INVENTION

This invention relates to a storage cabinet, and more particularly to various aspects of a storage cabinet that facilitate storage of weapons such as rifles, pistols and other firearms, as well as related equipment and accessories.

In certain military, police and other environments, there is a need to safely and securely store firearms and related equipment in a manner such that the firearms and related equipment are quickly and easily accessible when necessary. There is a further need to ensure that firearm storage occupies a minimal amount of space, especially when open, since it is frequently the case that personnel must quickly gain access to the firearms and related equipment and move to an exit area of a room or facility in which the firearms and related equipment are stored. This need is especially keen in a naval environment, since available space is at a premium on naval vessels. In addition, there is a need for a firearm and related equipment storage system which can be tailored according to specific user requirements or applications, either at the time of manufacture or in a retrofit manner.

The present invention contemplates a storage cabinet assembly that is well suited for use in storing firearms and related equipment. In accordance with one aspect of the invention, a storage cabinet system includes a cabinet defining an interior and including a door arrangement movable between an open position providing access to the cabinet interior and a closed position preventing access to the cabinet interior. The storage cabinet system further includes a series of differently configured storage components or modules that are adapted to be mounted within the cabinet interior. Certain of the storage components or modules are in the form of firearm storage components or modules that are configured to support and store firearms within the cabinet interior. The firearm storage components include one or more stock rests, one or barrel rests, and one or more pistol supports.

The stock rests are adapted to be mounted to the cabinet so as to be located in a lower area of the cabinet interior. Each stock rest includes an upwardly facing stock support surface that is configured so as to accommodate the stock of a certain type of firearm. The stock support surfaces are configured to engage the butt end of a stock of a firearm, and to position the firearm such that the firearm leans toward the back wall of the storage cabinet.

The one or more barrel rests are adapted to be secured within the cabinet interior at a location above the stock rests. Each barrel rest includes a recess configured to receive and engage a firearm barrel at a location above the stock rest, so as to position the firearm in an upright orientation within the cabinet interior. The orientation and position of the barrel rests is such that each barrel rest prevents the upper end of the firearm from contacting the rear wall of the cabinet. Each barrel rest includes a mounting section for use in mounting the barrel rest within the cabinet interior, and a barrel rest section that extends outwardly from the mounting section and is configured to receive and engage the barrel of a certain type of firearm adapted to be supported by the stock rest located below the barrel rest. The stock rests and barrel rests function to support the firearm from below and to cradle the upper end of the firearm, so that the firearm can be quickly and easily grasped and removed from the support components when needed.

Each pistol support also includes a mounting section for use in mounting the pistol support within the cabinet interior, and a pistol support section that extends outwardly from the mounting section. The pistol support section is in the form of an elongated finger or rod oriented at an upwardly extending angle, which is adapted to be received within the barrel of a pistol for supporting the pistol within the cabinet interior. The pistol support is configured such that the pistol handle faces outwardly when the pistol barrel is engaged with the finger or rod, so that the pistol can be easily and quickly grasped and removed from the pistol support when necessary.

The barrel rests and the pistol supports are secured within the cabinet interior via a mounting member that is configured to engage and support the barrel rests and the pistol supports. In one form, the mounting member is engaged with and extends between a pair of vertical support members forming a part of the cabinet. The mounting member and the vertical support members include engagement structure which enables the mounting member to be secured within the cabinet interior at different elevations, so as to provide flexibility in the height of the barrel rests and pistol supports relative to the stock rest. The mounting member and the mounting sections of the barrel rests and pistol supports include engagement structure which enables the barrel rests and pistol supports to be placed in a variety of different positions on the mounting member, to provide additional flexibility in the configuration of the components within the cabinet interior.

In addition to the firearm support components described above, the present invention further contemplates shelf or bin-type storage components or modules that may be positioned within the cabinet interior so as to store firearm related equipment and accessories. The shelf or bin-type storage components may be mounted in the cabinet interior along with the firearm storage components as described, or may be mounted within the cabinet interior in place of the firearm storage components.

The present, invention further contemplates a door and lock system for a storage cabinet, which is particularly well suited for use in storing firearms and related equipment within the cabinet. In accordance with this aspect of the invention, a storage cabinet assembly includes a cabinet defining an interior, in combination with a folding door arrangement mounted to the cabinet. The folding door arrangement includes a pair of folding bifold door sections, each of which includes an inner door member and an outer door member. The folding door sections are movable between a closed position in which the folding door sections prevent access to the cabinet interior, and an open position in which the folding door sections provide access to the cabinet interior. The inner door members of the folding door sections are located adjacent each other when the folding door sections are in the closed position.

A locking arrangement is associated with the folding door arrangement, for selectively preventing movement of the folding door sections away from the closed position. The locking arrangement includes a locking or latch member carried by each of the folding door sections, with each latch member being movable between an engaged position and a disengaged position. Each latch member in its engaged position maintains its associated door section in the closed position, and in the disengaged position enables movement of the door section between the closed position and the open position. The locking arrangement further includes a movable control member carried by each door section. Each control member is interconnected with one of the latch members, and the control members are movable between a first, locking position in which the control members place the latch members in the engaged position, and a second, release position in which the control members place the latch members in the disengaged position. The control members in the first, locking position overlie the inner door members, and are adapted to be secured together to maintain the door sections in the closed position. In this manner, the control members provide a single point locking mechanism for selectively preventing access to the interior of the cabinet. In a preferred form, the control members define inner ends that are located adjacent each other when the control members are in the first, locking position. The inner ends of the control members include openings, and a lock is engageable through the openings so as to selectively maintain the control members in the first position.

In accordance with another aspect of the invention, a storage cabinet assembly includes a cabinet defining an interior, in combination with a folding door arrangement including a pair of folding door sections, as described above. The inner and outer door members of each door section are movable together when the door section is in the open position. The cabinet defines a recess in alignment with the folded door members when the door sections are in the open position. An extension and retraction mechanism is interconnected with each door section, to enable each door section to be moved into one of the recesses when the door section is in the open position. In this manner, the doors can be recessed when opened, to prevent the doors from interfering with personnel gaining access to the items contained within the cabinet.

The invention also contemplates a method of configuring a storage cabinet, substantially in accordance with the foregoing summary.

The various features and aspects of the present invention may be utilized separately or in various subcombinations, and each provides advantages in construction, assembly or operation of a storage cabinet, particularly suitable for use in storing firearms and related equipment. In a preferred form, the various features and aspects of the invention are utilized in combination so as to provide a storage cabinet, as well as a method of constructing and configuring a storage cabinet, that are particularly advantageous in storing of firearms and related equipment and accessories.

Various other features, objects and advantages of the invention will be made apparent from the following description taken together with the drawings.

BRIEF DESCRIPTION OF THE DRAWINGS

The drawings illustrate the best mode presently contemplated of carrying out the invention.

In the drawings:

FIG. 1 is an isometric view of a storage cabinet constructed in accordance with the present invention, which is particularly well suited for use in storing firearms and related equipment, in which the doors of the storage cabinet are shown in a closed position;

FIG. 2 is a front elevation view of the storage cabinet of FIG. 1;

FIG. 4 is an isometric view similar to FIGS. 1 and 3, showing the storage cabinet doors in the open position and moved to a retracted position, to provide access to the contents of the storage cabinet;

FIG. 8 is a section view taken along line 8-8 of FIG. 5;

FIG. 23 is an enlarged partial isometric view showing certain of the barrel rest and pistol support components secured to the mounting member as in FIG. 22;

FIG. 24 is a partial section view taken along line 24-24 of FIG. 23;

FIG. 25 is a partial elevation view showing the manner in which firearms such as rifles and pistols are supported within the interior of the storage cabinet of FIG. 1;

DETAILED DESCRIPTION OF THE INVENTION

Figure 3:
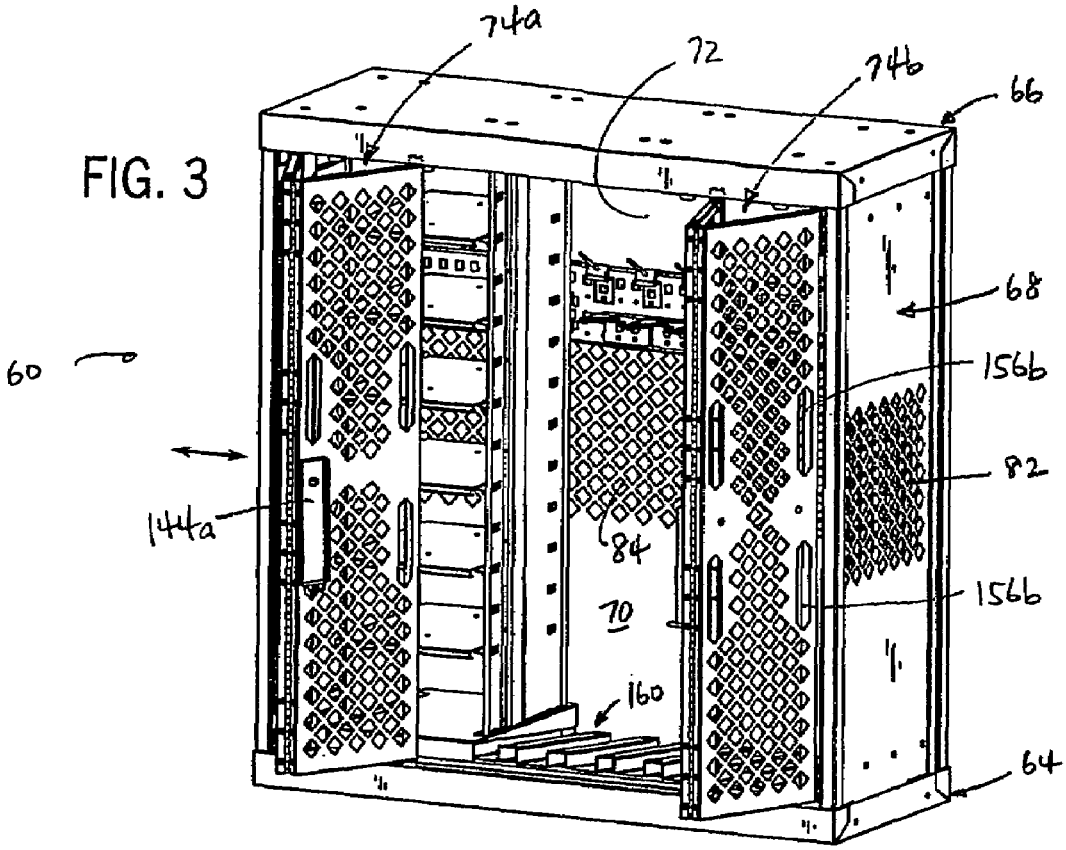
FIG. 3 is an isometric view of the storage cabinet of FIG. 1, showing movement of the storage cabinet doors toward an open position.

Referring to FIGS. 1-4, a storage cabinet assembly 60 includes a storage cabinet 62 having a base 64, a top 66, a pair of side walls 68 and a back wall 70. Representatively, storage cabinet 62 may have a conventional four post construction, in which corner posts C1, C2, C3 and C4 extend vertically between the corners of base 64 and top 66, and side walls 68 and back wall 70 are secured to and extend between the corner posts. It is understood, however, that the overall construction of storage cabinet 62 may take any other satisfactory form. In a manner to be explained, storage cabinet assembly 60 is especially well suited for use in a military or related application, for storing weapons such as firearms, and related equipment.

Figure 11:
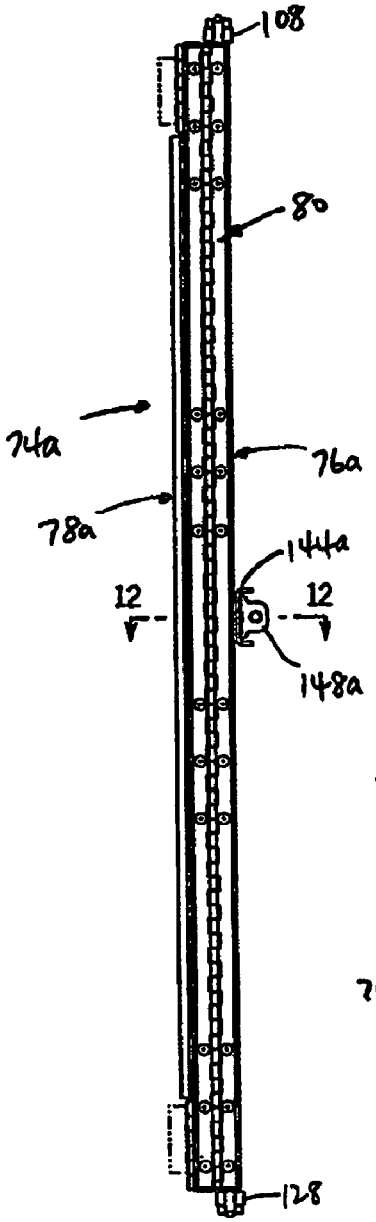
FIG. 11 is an end elevation view of one of the door sections incorporated in the storage cabinet assembly of FIG. 1, showing the door members of the door section folded together as in FIGS. 6 and 7.

Storage cabinet 62 is constructed such that base 64, top 66, side walls 68 and back wall 70 cooperate to define an interior 72 that is accessible through an open front. A pair of bifold doors, shown generally at 74*a*, 74*b*, are configured to selectively close the open front of storage cabinet 62 and to selectively provide access to interior 72 of storage cabinet 62 through the open front. Bifold doors 74*a*, 74*b* are of mirror image construction, and include respective inner door sections 76*a*, 76*b* and outer door sections 78*a*, 78*b*. The facing edges of inner door section 76*a* and outer door section 78*a* are connected together via a piano-type hinge, such as shown in FIG. 11 at 80, in a manner as is known. The facing edges of inner door section 76*b* and outer door section 78*b* are also connected together via a similar hinge. Each of door sections 76*a*, 76*b*, 78*a* and 78*b* may be formed of a sheetmetal material in a manner as is known.

Side walls 68 include a series of perforations 82, and back wall 70 includes a series of perforations 84. In addition, door sections 76*a*, 76*b*, 78*a*, 78*b* include perforations 86, which occupy substantially the full height of each door section and the full width of each door section, with the exception of the center area of the door section. Perforations 82, 84 and 86 function to provide ventilation to interior 72 of storage cabinet 62. In addition, perforations 86 in door sections 76*a*, 76*b*, 78*a* and 78*b* provide visual access to the entire usable area of storage cabinet interior 72 when doors 74*a*, 74*b* are closed, to allow a user to inspect the contents of storage cabinet 62 without the need to move bifold doors 74*a*, 74*b* to the open position.

Figure 6:
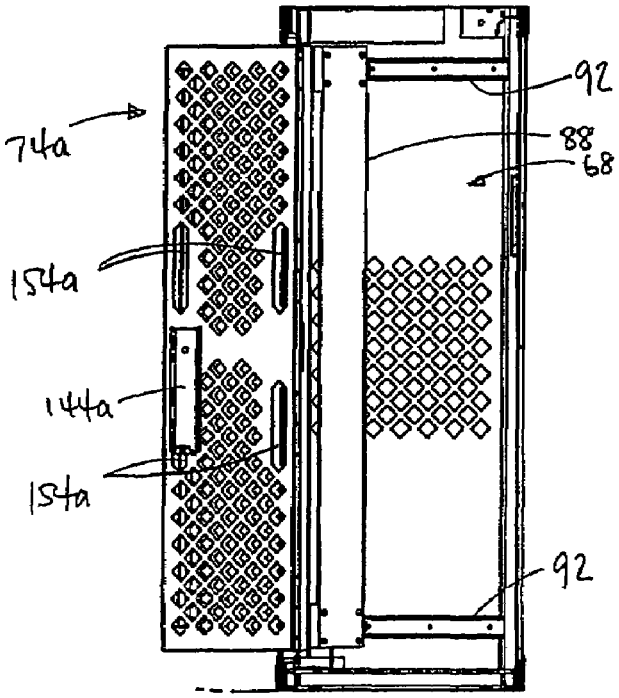
FIG. 6 is a section view taken along line 6-6 of FIG. 5, showing one of the doors of the storage cabinet prior to movement of the door to the retracted position.
Figure 7:
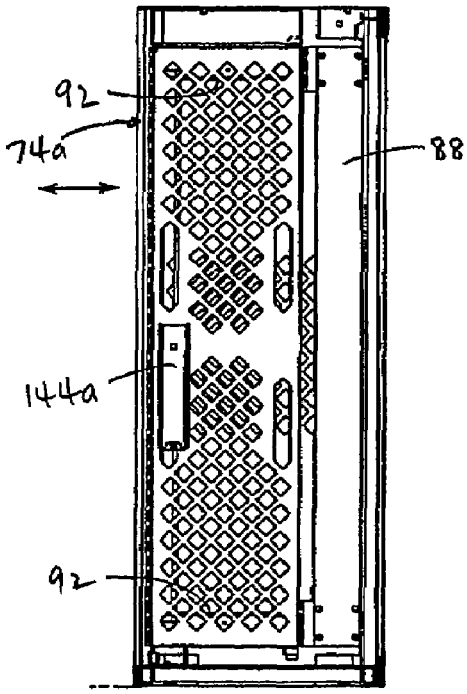
FIG. 7 is a view similar to FIG. 6, with reference to line 7-7 of FIG. 5, showing the door in the retracted position.
Figure 5:
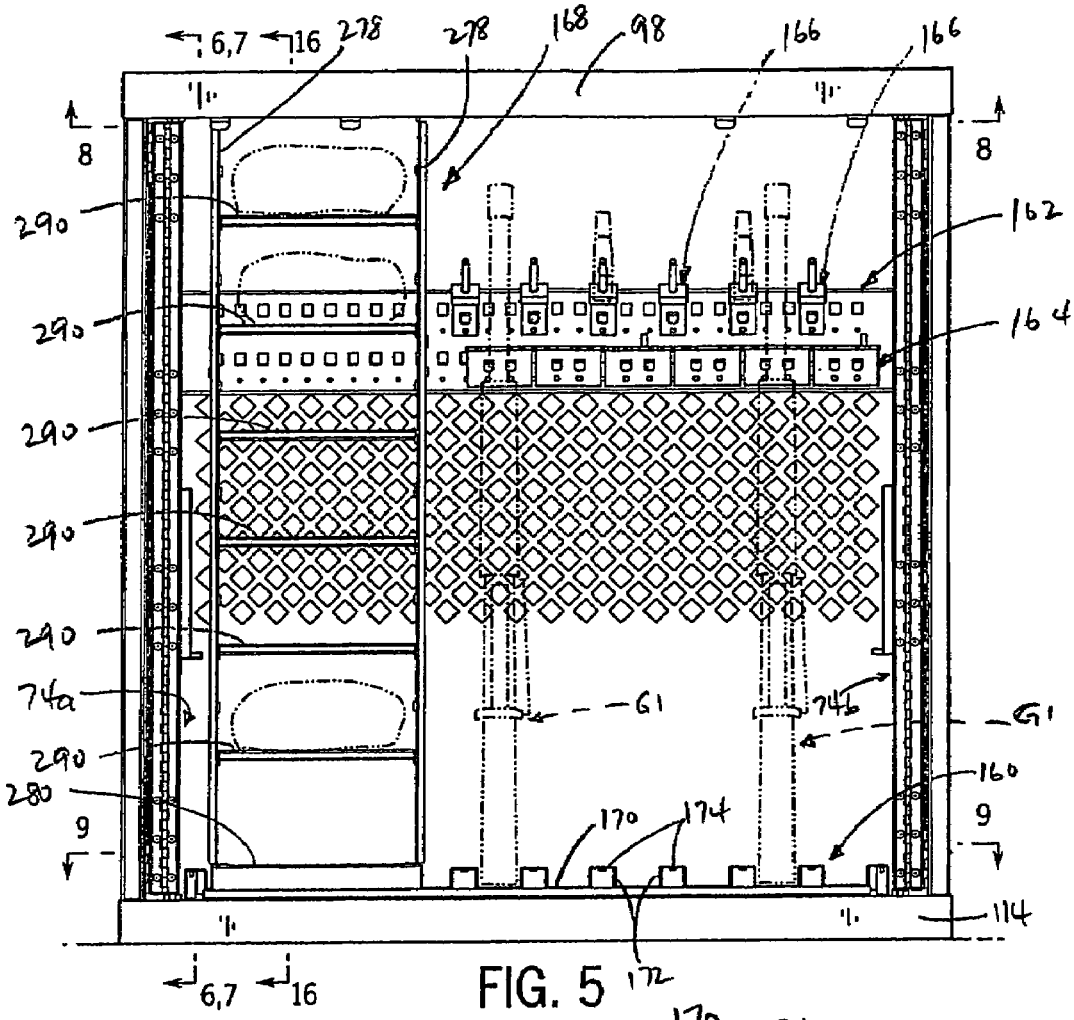
FIG. 5 is a front elevation view of the storage cabinet of FIG. 4.

FIGS. 1 and 2 show bifold doors 74*a*, 74*b* in a closed position, in which bifold doors 74*a*, 74*b* prevent access to interior 72 of storage cabinet 62. FIG. 3 illustrates bifold doors 74*a*, 74*b* in an intermediate position between the closed position of FIGS. 1 and 2 and an open position, which provide access to interior 72 of storage cabinet 62. FIG. 6 shows the position of bifold door 74*a* when bifold door 74*a* is fully open, and FIGS. 5 and 7 show bifold door 74*a* in the fully open position and retracted into interior 72 of storage cabinet 62 so as not to obstruct access to items contained within storage cabinet interior 72. Bifold door 74*b* is similarly movable to an open and retracted position within storage cabinet interior 72.

Referring to FIGS. 6-8, bifold door 74*a* is mounted to a carnage member 88 via a piano hinge 90, which is interconnected between an outer edge defined by carriage member 88 and an adjacent outer edge defined by outer door section 78*a* of bifold door 74*a*. Carriage member 88 extends generally vertically, and is movably mounted at its ends to a pair of guide rails 92. Guide rails 92 extend in a forward-rearward direction within cabinet interior 72, and are located adjacent one of side walls 68. In one embodiment, guide rails 92 may be mounted to, corner posts C1 and C3, although it is understood that guide rails 92 maybe mounted in any other satisfactory manner within cabinet interior 72. In a manner as is known, carriage member 88 is mounted to upper and lower roller assemblies, each of which is engaged with one of guide rails 92 for movement along the guide rail 92. With this construction, bifold door 74*a* is movable as a unit when in the open position, between an extended position as shown in FIG. 6, in which carriage member 88 is located in a forward position on guide rails 90, and a retracted position as shown in FIG. 7, in which carriage member 88 is moved to a rearward position on guide rails 92. When in the retracted position, bifold door 74*a* is fully recessed into storage cabinet interior 72.

A similar set of guide rails 92 is located adjacent the opposite side wall 68 of storage cabinet 62, to provide movement of bifold door 74*b* between an extended position and a retracted position when bifold door sections 76*b* and 78*b* of bifold door 74*a* are in the open position, via a similar carriage member. In this manner, both bifold doors 74*a* and 74*b* can be recessed within storage cabinet interior 72 when bifold doors 74*a* and 74*b* are in the open position.

Figure 10:
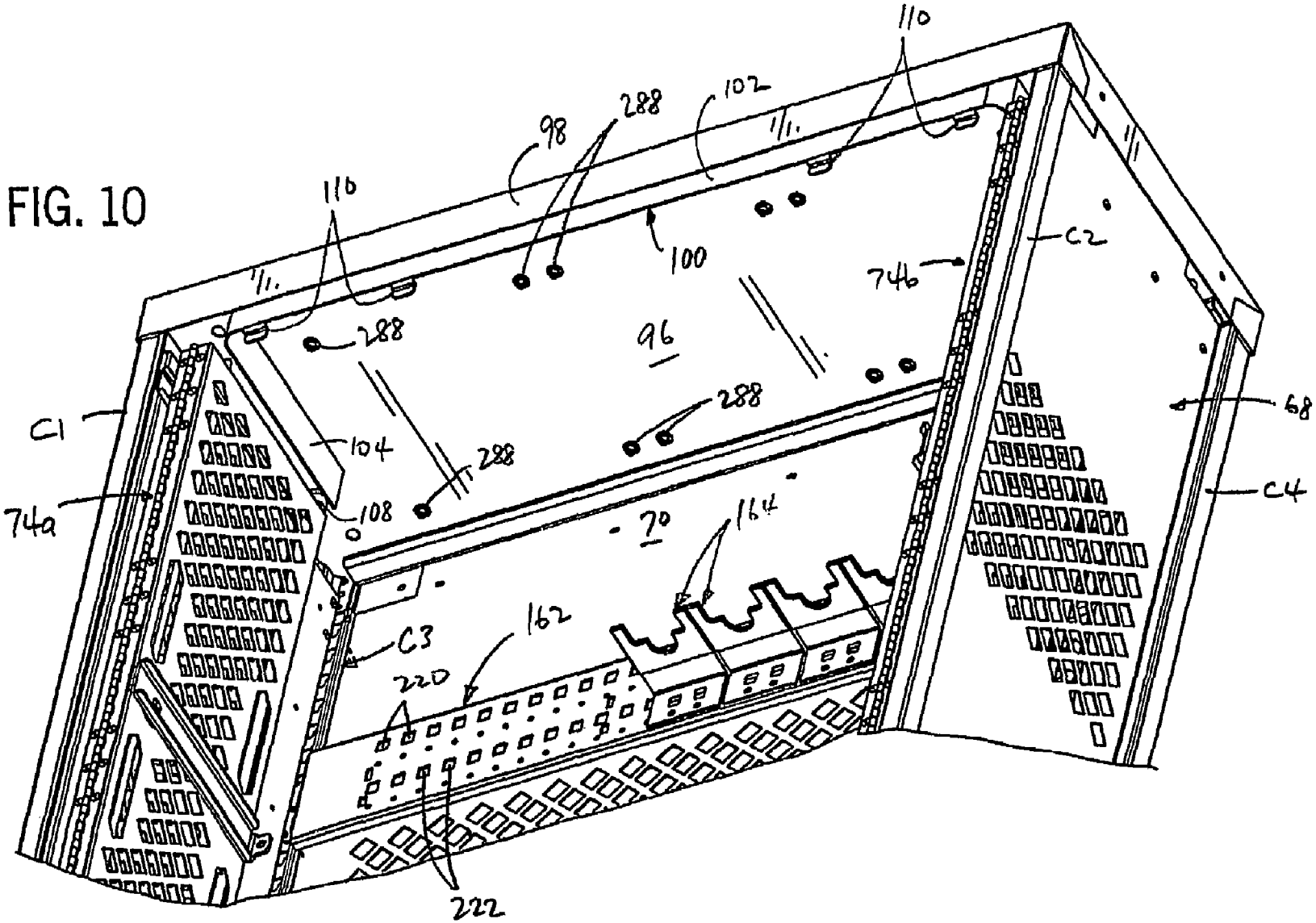
FIG. 10 is a partial isometric view showing an upper portion of the storage cabinet of FIG. 1 including an underside defined by a top wall of the storage cabinet, and showing the storage cabinet doors in the open and retracted position.

FIGS. 8 and 10 illustrate a bifold door guide arrangement for guiding movement of bifold doors 74*a* and 74*b* between the closed position of FIGS. 1 and 2 and the open position of FIGS. 4 and 5. In the illustrated embodiment, storage cabinet top 66 defines a top panel 96, the lower surface of which defines the upper extent of storage cabinet interior 72. In addition, storage cabinet top 66 defines a front wall 98 that extends downwardly from the lower surface of top panel 96, and along the width of the front of storage cabinet 62. The bifold door guide arrangement includes a generally U-shaped guide wall 100 secured to the lower surface of top panel 96. Guide wall 100 includes an elongated transverse front section 102 spaced rearwardly of front wall 98 of storage cabinet top 66, and a pair of side sections 104, each of which is spaced inwardly from one of storage cabinet side walls 68. Front wall 98 and front section 102 of guide wall 100 cooperate to define a guide channel 106, and side sections 104 of guide wall 100 are spaced inwardly from storage cabinet side walls 68 a distance slightly greater than the width of the bifold doors 74*a*, 74*b* when in the folded position. The inner bifold door sections 76*a*, 76*b* each include a guide roller 108, which is adapted to move within the space between one of side walls 68 and the adjacent guide wall side section 104 during movement of the bifold doors 74*a*, 74*b* between the extended position and the retracted position and to move within guide channel 106 during movement of the bifold doors 74*a*, 74*b* between the open and closed positions. Front section 102 of guide wall 100 includes a series of depending stop tabs 110, which engage the upper edges of bifold door sections 76*a*, 76*b* and 78*a*, 78*b*, to position bifold doors 74*a*, 74*b* in the closed position, in which the bifold door sections 76*a*, 76*b*, 78*a* and 78*b* are generally coplanar.

Figure 9:
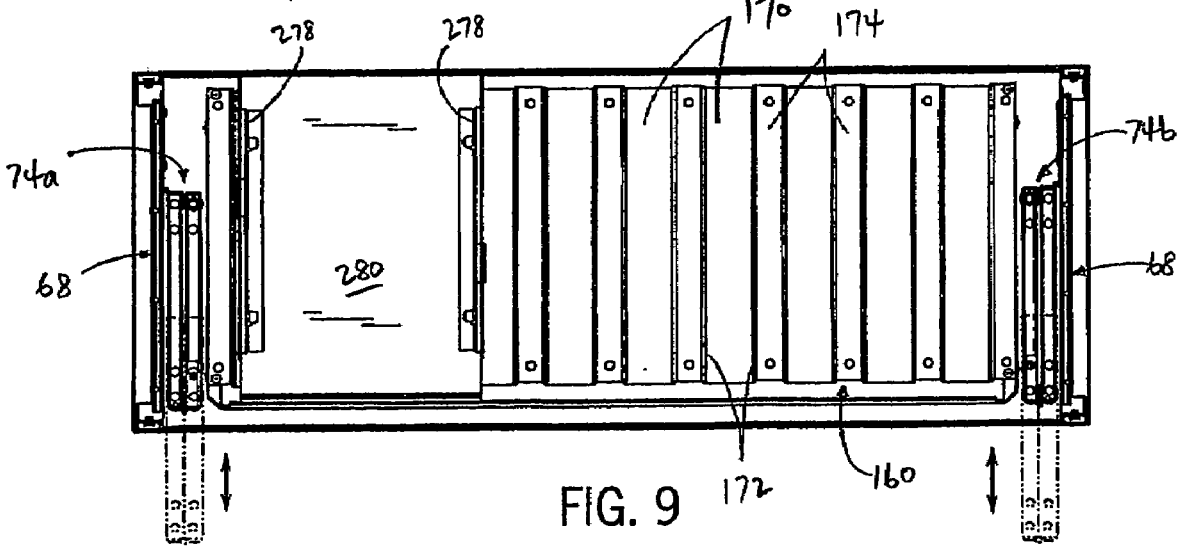
FIG. 9 is a section view taken along line 9-9 of FIG. 5.
Figures 15, 16:
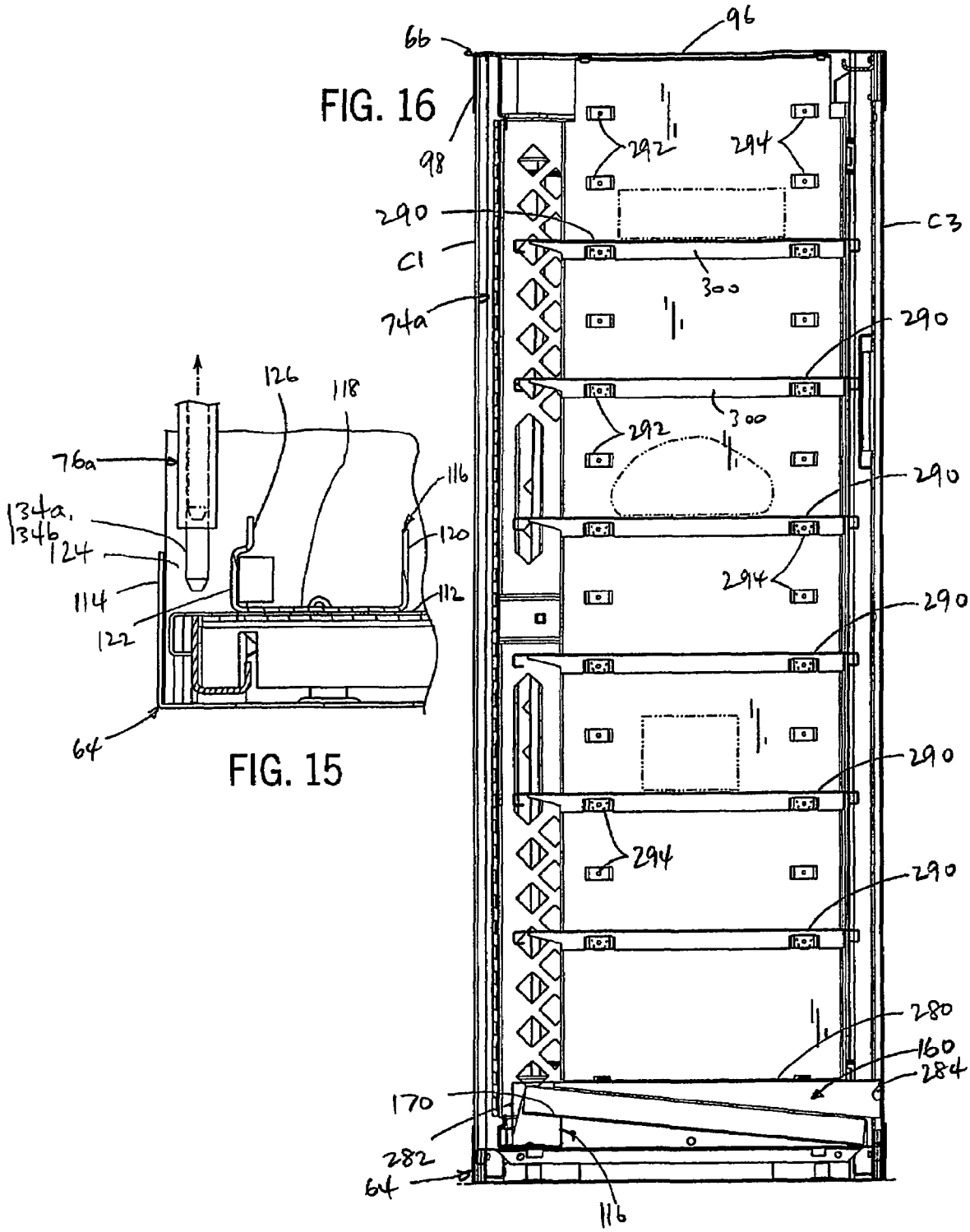
FIG. 15 is a partial section view along line 15-15 of FIG. 2, showing a lower area of the storage cabinet and an end portion of one of the latch members incorporated in the latch arrangement of FIGS. 13 and 14.
FIG. 16 is a section view taken along line 16-16 of FIG. 5.
Figure 17:
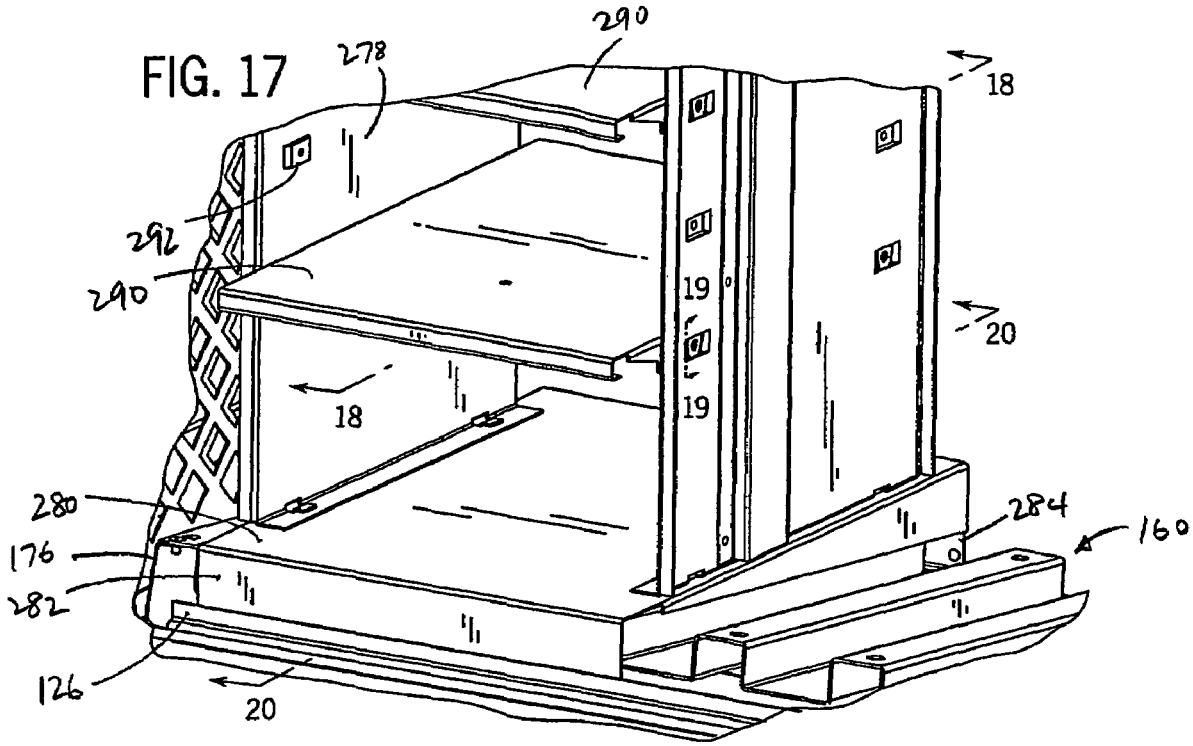
FIG. 17 is a partial isometric view showing a lower area of a shelf or bin component contained within the cabinet interior, as shown in FIG. 16, as well as a portion of a stock rest mounted within the lower area of the cabinet interior.

Referring to FIGS. 9 and 15, storage cabinet base 64 includes a horizontal base wall 112 that defines the lower extent of storage cabinet interior 72, and a front wall 114 that extends vertically above the upper surface of base wall 112. Base 64 further includes a transversely extending channel 116 secured to horizontal base wall 112 and spaced rearwardly from front wall 114. Channel 116 includes a lower wall 118 that rests on and engages horizontal base wall 112, in combination with an upwardly extending rear wall 120 and a forward wall 122 spaced rearwardly from front wall 114 of base 64 so as to define a space 124 therebetween. The upper portion of front wall 122 defines a stop section 126 located above the upper edge of front wall 114. Stop section 126 is configured to engage the lower edges of bifold door sections 76*a*, 76*b*, 78*a* and 78*b* when bifold doors 74*a* and 74*b* are in the closed position, to maintain the bifold door sections in a coplanar relationship along with stop tabs 110.

Inner bifold door sections 76*a*, 76*b* each include a guide roller 128 that is positioned within space 124, to provide a lower guide for movement of bifold doors 74*a*, 74*b* between the open and closed positions.

Figure 12:
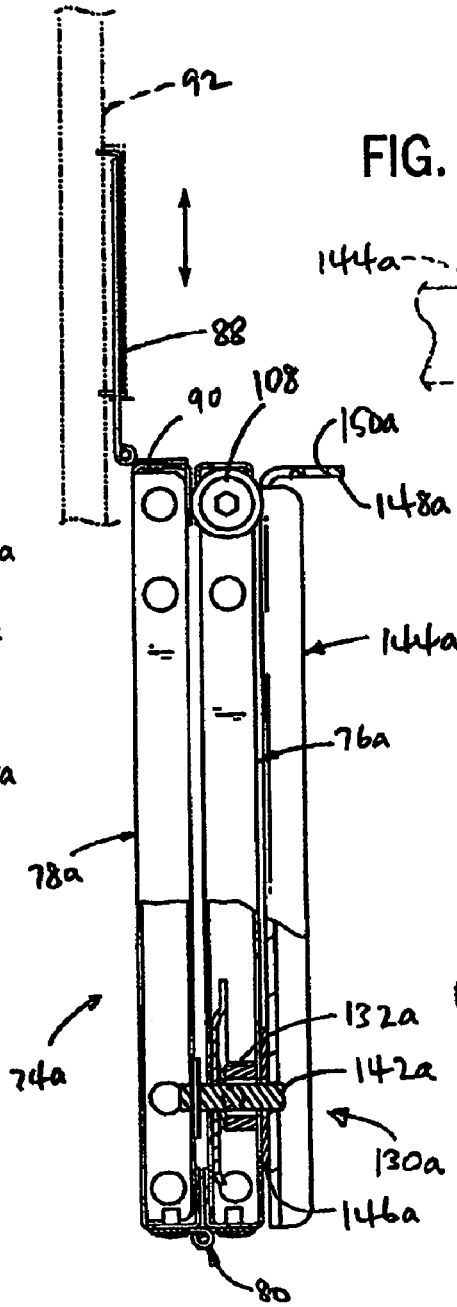
FIG. 12 is a partial section view taken along line 12-12 of FIG. 11.
Figure 13:
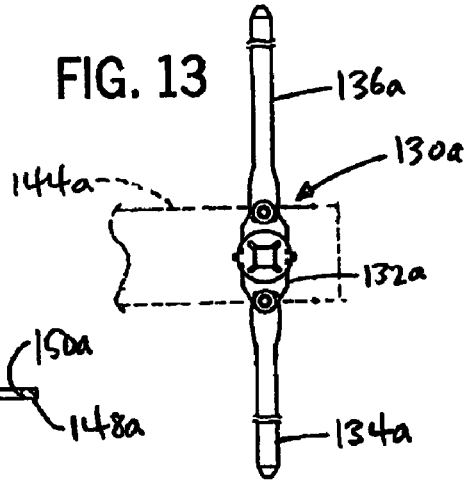
FIG. 13 is a partial elevation view showing components of a latch or lock arrangement incorporated into the door section of FIGS. 11 and 12, showing the components of the latch or lock arrangement in an extended, locking position.
Figure 14:
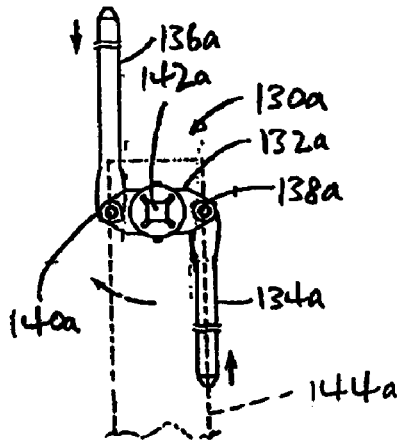
FIG. 14 is a view similar to FIG. 13, showing the components of the latch or lock arrangement in a retracted, release position.

Bifold doors 74*a*, 74*b* include a single-point locking system to selectively maintain bifold door sections 76*a*, 78*a* and 76*b*, 78*b* in the closed position, to prevent access to storage cabinet interior 72. The locking system includes a locking mechanism interconnected with each of bifold doors 74*a*, 74*b*. The locking mechanism of bifold door 74*a* is shown in FIGS. 12-14 at 130*a*, and it is understood that a similar locking mechanism is interconnected with bifold door 74*b*. The following description of locking mechanism 130*a* applies equally to the locking mechanism interconnected with bifold door 74*b*, and like reference characters will be used throughout the remainder of this disclosure, with the understanding that components of the locking mechanism interconnected with bifold door 74*b* will be referred to using the subscript "b" in place of "a" as in the following description.

As shown in FIGS. 11-14, locking mechanism 130*a* includes a locking hub 132*a* pivotably mounted to the inside of inner door section 76*a* adjacent the hinge joint between inner door section 76*a* and outer door section 76*b*. A lower lock rod 134*a* extends downwardly from locking hub 132*a*, and an upper lock rod 136*a* extends upwardly from locking hub 132*a*. Lock rods 134*a*, 136*a* are mounted to opposite sides of locking hub 132*a* via respective pivot connections 138*a*, 140*a*. Locking hub 132*a* is pivotably mounted to inner door section 76*a* via an axle 142*a*, which has an irregular (e.g. rectangular) cross section and which extends through a mating opening in locking hub 132*a*. Lock rod pivot connections 138*a*, 140*a* are offset from the pivot axis defined by axle 142*a*.

The outer end of axle 142*a* is engaged with a control member 144*a*. In a representative embodiment, control member 144*a* includes an opening configured to receive the irregular cross section of axle 142*a*. Alternatively, axle 142*a* may be rigidly secured to control member 144*a*, such as by welding or in any other satisfactory manner. With this construction, control member 144*a* is pivotable about a pivot axis defined by axle 142, and movement of control member 144*a* is operable to impart pivoting movement to axle 142*a*. A washer or bushing 146*a* is located between control member 144*a* and the outer surface of inner door section 76*a*, to facilitate movement of control member 144*a*. Control member 144*a* includes an ear 148*a* in which an opening 150*a* is formed.

Lock rods 134*a*, 136*a* are configured so as to be movable between an extended, engaged position and a retracted, disengaged position in response to rotation of locking hub 132*a*, which in turn is caused by movement of control member 144*a*. FIG. 13 shows lock rods 134*a*, 136*a* in the extended, engaged position, and FIG. 14 illustrates lock rods 134*a*, 136*a* in the retracted, disengaged position. In the extended position, the end of lower lock rod 134*a* projects downwardly from the lower edge of inner door section 76*a*, and extends through an opening in the lower edge of inner door section 76*a*. Similarly, in the extended position, the end of upper lock rod 136*a* projects upwardly from the upper edge of inner door section 76*a*, and extends through an opening in the upper edge of inner door section 76*a*. In the retracted position, the ends of lock rods 134*a*, 136*a* are positioned flush with or slightly recessed from the edge of inner door section 76*a* from which the respective lock rod ends extend when in the extended position.

Control member 144*a* is movable between a first raised, locking position and a second lowered, release position. When in the locking position, control member 144*a* is oriented generally horizontally, and extends across the width of inner door section 76*a*. Control member 144*a* is constructed such that, when in the locking position, ear 150*a* is located so as to be in alignment with the inner edge of inner door section 76*a*.

In operation, storage cabinet assembly 60 is locked by positioning control members 144*a*, 144*b* in the locking position as shown in FIG. 1. In this position, control members 144*a*, 144*b* function to place lock mechanisms 130*a*, 130*b*, respectively, in the engaged position by positioning the respective locking hubs 132*a*, 132*b* in the locking position as shown in FIG. 13, in which the respective lock rods 134*a*, 136*a* and 134*b*, 136*b* are extended. In the extended position, the ends of lower lock rods 134*a*, 134*b* are positioned within space 124 (FIG. 15), between front wall 114 and forward wall 122 of channel 116. Similarly, upper lock rods 136*a*, 136*b* are positioned within guide channel 106 between front wall 98 and front section 102 of guide wall 100. The positioning of locking mechanisms 130*a*, 130*b* adjacent the joints between the sections of bifold doors 74*a*, 74*b* is such that, when bifold doors 74*a*, 74*b* are closed and control members 144*a*, 144*b* are moved to the locking position, lock rods 134*a*, 134*b* and 136*a*, 136*b* prevent movement of bifold doors 74*a*, 74*b* to the open position.

Ears 148*a*, 148*b* of respective control members 144*a*, 144*b* are located adjacent each other when control members 144*a*, 144*b* are in the locking position, and openings 150*a*, 150*b* in control member ears 144*a*, 144*b*, respectively, are in alignment with each other. A lock 152, which may be a key or combination padlock or any other satisfactory type of locking mechanism, includes a locking member that extends through the aligned openings 150*a*, 150*b* when control members 144*a*, 144*b* are in the locking position, to prevent movement of control members 144*a*, 144*b* away from the locking position. It can thus be appreciated that the construction of bifold doors 74*a*, 74*b* and locking mechanisms 130*a*, 130*b* provides a single-point locking arrangement for a bifold door construction, to enable quick and easy opening of bifold doors 74*a*, 74*b* when desired, in a manner that exposes substantially the entire open front of storage cabinet assembly 60.

Control members 144*a*, 144*b* are subjected to a gravity bias that tends to move control members 144*a*, 144*b* away from the raised, locking position of FIG. 1 toward the lowered, release position of FIG. 3. In this manner, when an authorized user removes lock 152 from within openings 150*a*, 150*b* of respective control member ears 144*a*, 144*b*, the inner ends of control members 144*a*, 144*b* are pivoted away from each other under the force of gravity to the lowered, release position. Such movement of control members 144*a*, 144*b* causes respective locking hubs 132*a*, 132*b* to pivot to the release position of FIG. 14 so as to place lock rods 134*a*, 134*b* and 136*a*, 136*b* in the retracted position. This action functions to automatically disengage locking mechanisms 130*a*, 130*b* when lock 152 is removed, to facilitate quick and easy opening of storage cabinet assembly 60 when desired.

In the retracted position, the ends of upper lock rods 136*a*, 136*b* are moved vertically downwardly out of engagement within guide channel 106, and the ends of lower lock rods 134*a*, 134*b* are raised vertically upwardly out of engagement within space 124. In this manner, the joints between bifold door sections 76*a*, 78*a* and 76*b*, 78*b* can move outwardly when the user applies an opening force to bifold doors 74*a*, 74*b*, to thereby enable movement of bifold doors 74*a*, 74*b* to the open position.

Door sections 76*a*, 78*a* and 76*b*, 78*b* include respective vertically spaced, vertically extending slots 154*a*, 156*a* and 154*b*, 156*b*, which are located adjacent the respective door section side edges. Slots 154*a*, 156*a* and 154*b*, 156*b* provide the visual access and ventilation functions as noted previously, along with perforations 86, and also function as handgrip areas to facilitate movement of bifold doors 74*a*, 74*b* between the open and closed positions.

Various storage or support components or modules are adapted to be secured within storage cabinet interior 72, in order to support and store weapons, firearms and related equipment or accessories within storage cabinet assembly 60. Such components include differently configured stock rests and barrel supports for supporting firearms such as rifles and automatic or semi-automatic machine guns or the like in an upright orientation within storage cabinet interior 72, as well as pistol supports and shelf or bin-type components. The configuration and orientation of the storage or support components contained within storage cabinet interior 72 may vary according to the intended use of storage cabinet assembly 60 and the equipment or accessories adapted to be stored within storage cabinet assembly 60. The storage or support components can be assembled in a predetermined configuration during initial manufacture, or may be subsequently assembled by a customer or user using supplied components. The positions of the components within storage cabinet interior 72 may be adjusted and varied, again according to user requirements. The drawing figures illustrate a number of various storage or support components or modules that may be mounted within storage cabinet interior 72, and it is understood that other storage or support components may be mounted within storage cabinet interior 72.

Referring to FIG. 4, one configuration of the storage or support components contained within storage cabinet interior 72 may include a stock rest 160, a support rail or mounting member 162 to which a series of barrel rests 164 and pistol supports 166 are mounted, along with a shelf or bin assembly 168.

Stock rest 160 is configured to receive and support the butt ends of a series of rifles or other weapons having a first configuration, in which the end of the weapon stock has a relatively narrow width, such as an M240 or M249 rifle, shown generally at G1 in FIGS. 5 and 25. Stock rest 160 includes a series of side-by-side upwardly facing channels or troughs defined by a series of lower walls 170 in combination with a spaced apart pair of side walls 172. A divider 174 is located between each channel or trough defined by stock rest 160.

Figure 20:
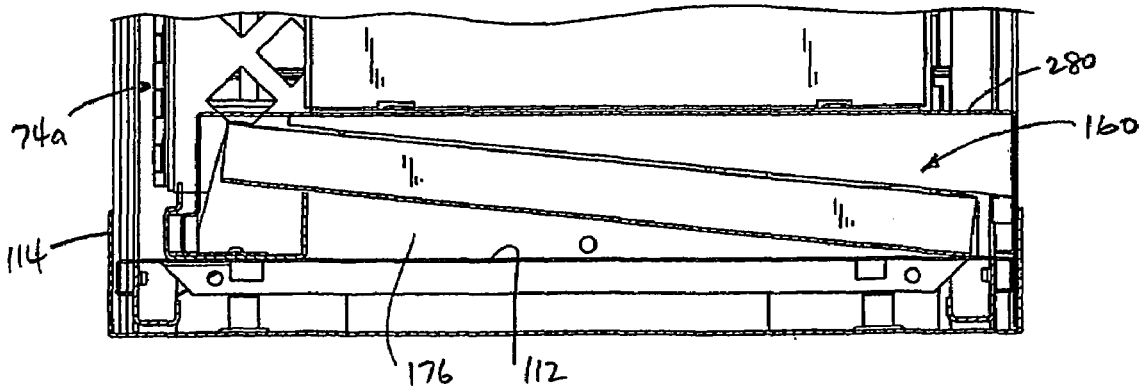
FIG. 20 is a partial section view taken along line 20-20 of FIG. 17.
Figure 21:
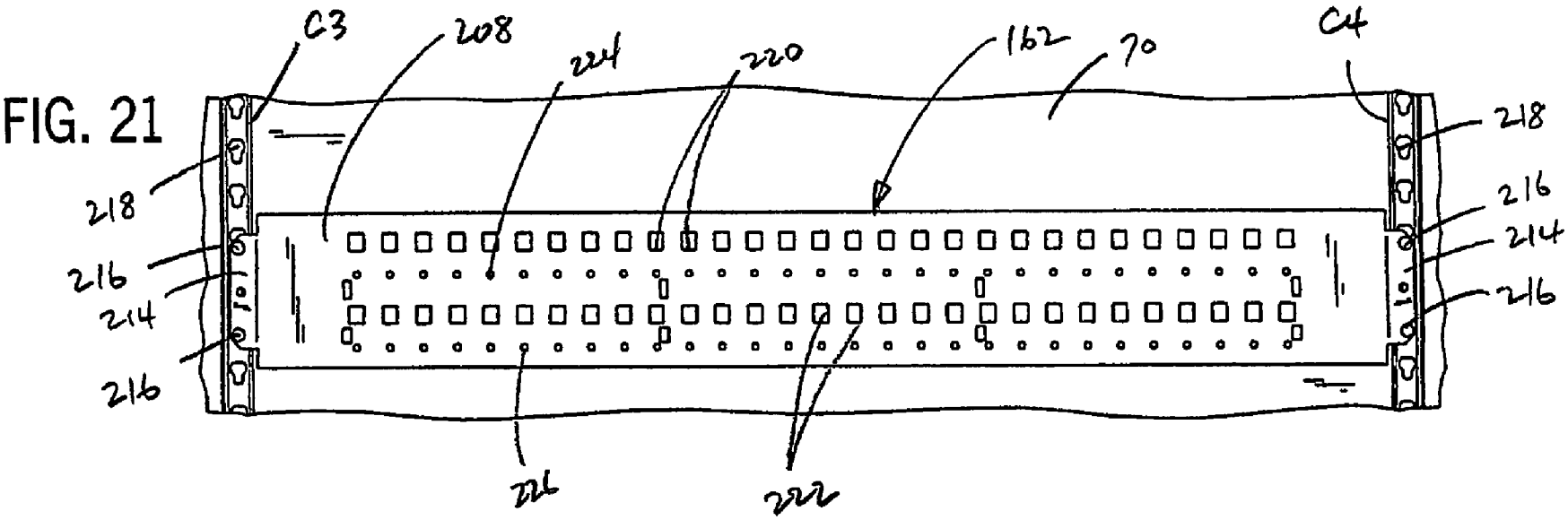
FIG. 21 is a partial elevation view of a mounting member positioned within the interior of the cabinet of FIG. 1, for use in mounting storage components within the interior of the cabinet.

Stock rest 160 is formed with a pair of end walls 176 (FIG. 20), which define lower edges that rest on horizontal base wall 112. Each end wall 176 defines a generally trapezoidal shape such that, when stock rest 160 is positioned on horizontal base wall 112, the channels or troughs defined by lower walls 170 and side walls 172 are oriented at an angle toward back wall 70 of storage cabinet 62. In this manner, when a gun or other weapon such as G1 is positioned so that its stock is received within one of the channels of stock rest 160, the weapon G1 is oriented so as to lean toward cabinet back wall 70.

Figure 30:
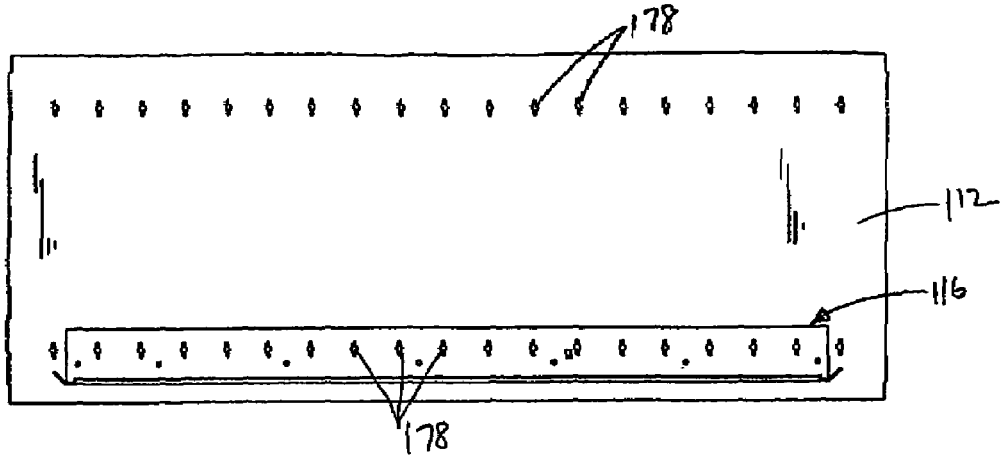
FIG. 30 is a top plan view of a lower wall defining the lower extent of the interior of the storage cabinet assembly of FIG. 1.
Figure 31:
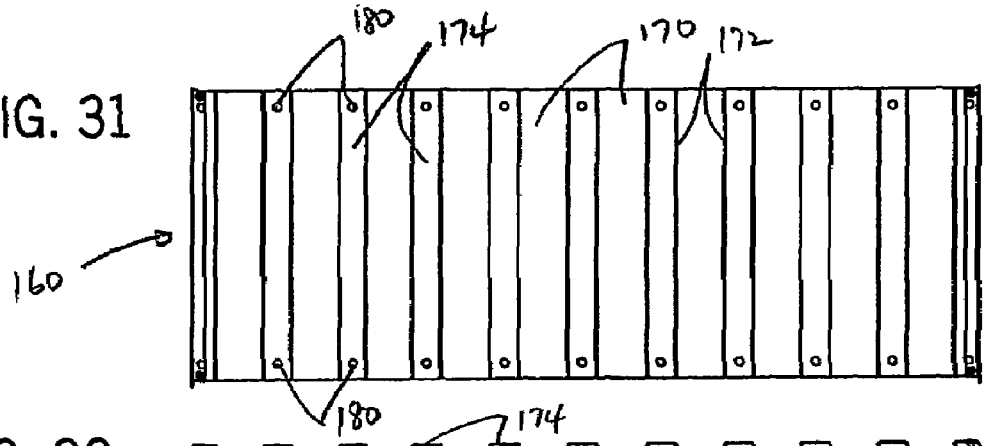
FIG. 31 is a top plan view of a first embodiment of a stock rest module or component adapted to be positioned within a lower area of the storage cabinet assembly of FIG. 1.
Figure 32:
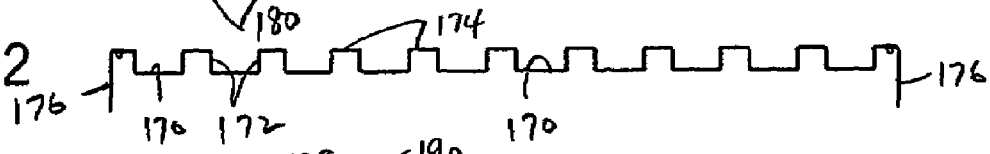
FIG. 32 is an elevation view of the stock rest of FIG. 31.

FIG. 30 is a plan view representation of horizontal base wall 112, which includes a series of spaced apart front and rear openings 178 that extend transversely throughout the majority of the length of horizontal base wall 112. Each opening 178 includes an enlarged central area and a pair of restricted end areas. With this construction, each opening 178 is adapted to receive an elongated mounting member such as a screw or other fastener, or a tab-type mounting member, for use in securing components or modules to base wall 112. As shown in FIG. 31, stock rest 160 includes openings 180 in dividers 174, which are positioned so as to be in vertical alignment with selected ones of horizontal base wall openings 178 when stock rest 160 is positioned within storage cabinet interior 72. Fasteners, such as threaded screws or the like, extend through the aligned openings 180 and 178, so as to secure stock rest 160 in position on horizontal base wall 112. Alternatively, each end wall 176 may include downwardly extending mounting tabs adapted to be engaged within selected openings 178, to secure stock rest to base wall 112.

Figure 33:
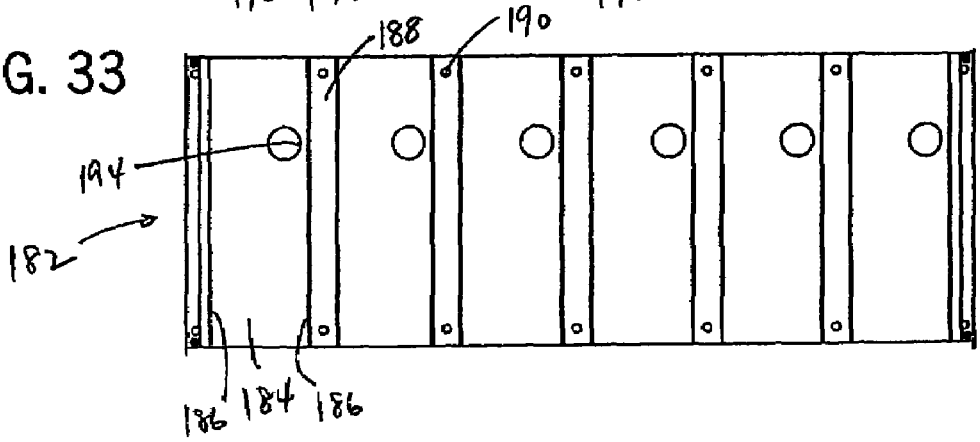
FIGS. 33 and 34 are top plan and elevation views, respectively, of another embodiment of a stock rest component or module adapted to be positioned within a lower area of the interior of the storage cabinet assembly of FIG. 1.
Figure 34:
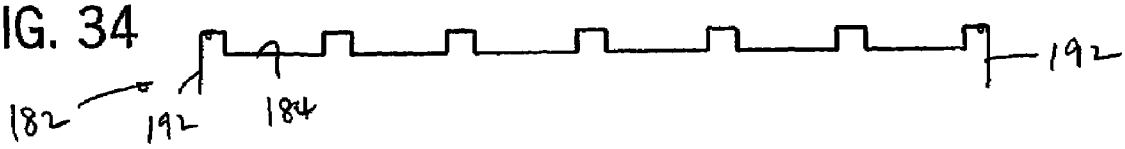

FIGS. 33 and 34 illustrate an alternative stock rest 182 which may be positioned within storage cabinet interior 72 in place of stock rest 160. Stock rest 182 has a similar overall configuration as stock rest 160, including a series of upwardly facing channels or troughs defined by lower walls 184 in combination with side walls 186. Dividers 188 are located between side walls 186 of adjacent troughs or channels, and include openings 190 for use in mounting stock rest 182 to horizontal base wall 112. Stock rest 182 further includes trapezoidal end walls 192 configured similarly to end walls 176 of stock rest 160, to orient stock rest 182 at an angle toward storage cabinet back wall 70. Stock rest 182 is configured to receive and support the butt end of each of a series of guns or other weapons having a configuration in which the stock is relatively wide, such as an M16 or M4 machine gun. Each lower wall 184 includes an opening 194 that is configured to receive the lower end of a weapon accessory, such as a scope or bayonet adapted for use with the weapon.

Figure 35:
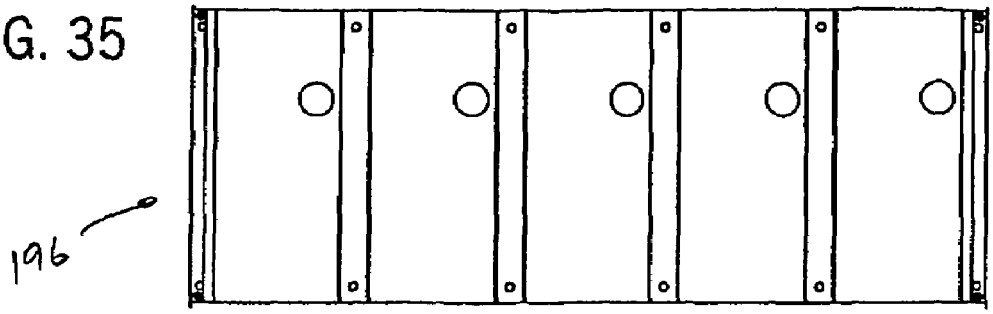
FIGS. 35 and 36 are top plan and elevation views, respectively, of another embodiment of a stock rest component or module adapted to be positioned within a lower area of the interior of the storage cabinet assembly of FIG. 1.
Figure 36:
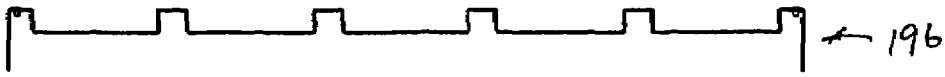
Figure 37:
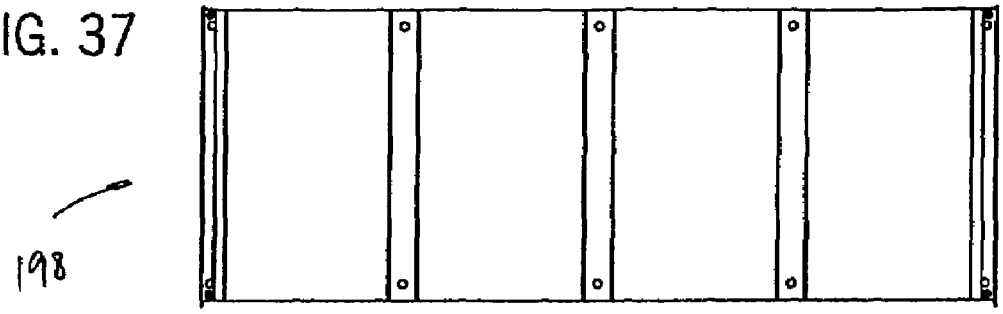
FIGS. 37 and 38 are top plan and elevation views, respectively, of another embodiment of a stock rest component or module adapted to be positioned within a lower area of the interior of the storage cabinet assembly of FIG. 1.
Figure 38:
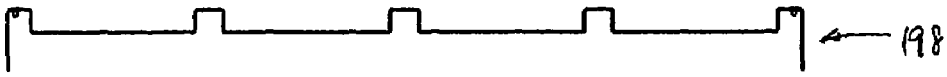
Figure 39:
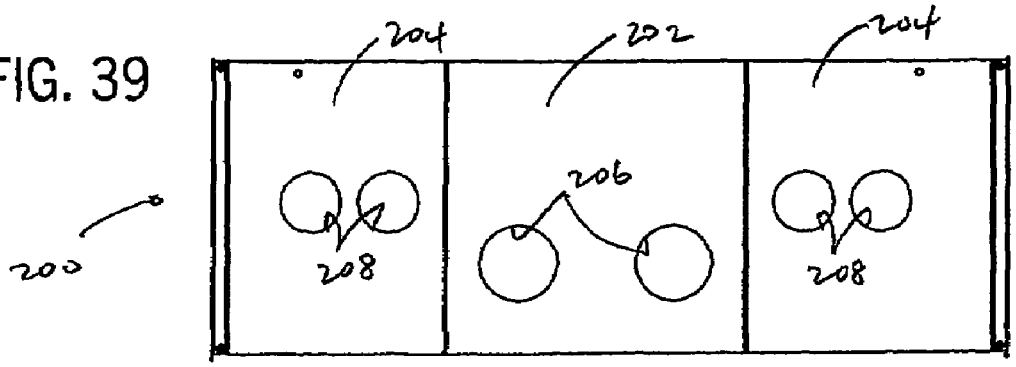
FIGS. 39 and 40 are top plan and elevation views, respectively, of another embodiment of a stock rest component or module adapted to be positioned within a lower area of the interior of the storage cabinet assembly of FIG. 1.
Figure 40:
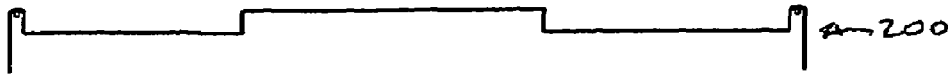

FIGS. 35 and 36 illustrate another configuration of a stock rest 196, which is constructed similarly to stock rest 182: Stock rest 196 is mounted within storage cabinet interior 72 in the same manner as noted previously, and is configured to support yet another type of weapon or other firearm in an upright orientation such that the weapon-or firearm leans toward back wall 70 of storage cabinet 62. FIGS. 37 and 38 a similarly constructed stock rest 198, which includes wider troughs or channels that are adapted to support other types of firearms. Stock rest 198 is also mounted within storage cabinet interior 72 in the same manner as stock rests 160 and 182, so as to position the firearms in an upright orientation leaning toward storage cabinet back wall 70. FIGS. 39 and 40 illustrate yet another stock rest 200 which is configured similarly to the previously described stock rests, and is mounted within storage cabinet interior 72 in the same manner. Stock rest 200 includes a central mounting section 202 in combination with a pair of side mounting sections 204. Circular openings 206, 208 are formed in mounting sections 202, 204, respectively, to receive the butt end of a weapon having a round configuration, such as an M2 machine gun or the like.

While certain stock rests 160, 182, 196, 198 and 200 are shown and described as being engageable within storage cabinet interior, it is understood that other stock rest configurations are possible and are contemplated within the scope of the present invention. Generally speaking, each stock rest is configured so as to support a weapon or other firearm in an upright orientation within storage cabinet interior 72, with the inclination of the stock end engagement area being such that the weapon is inclined toward cabinet back wall 70.

Referring to FIGS. 21-24, mounting member 162 defines a generally C-shaped cross section, including a support wall 208, in combination with upper and lower flanges 210, 212, respectively. Support wall 208 includes end extensions 214, which includes a pair of vertically spaced mounting studs or rivets 216, or any other satisfactory type of headed mounting members. Comer posts C3 and C4 of storage cabinet 62 include vertically spaced key hole openings 218, in accordance with conventional construction. Each key hole opening 218 includes an enlarged upper portion which is configured to receive the mounting studs 216 that extend rearwardly from extensions 214, which are then moved downwardly into engagement within a restricted lower portion of each key hole opening 218, so as to secure mounting member 162 to and between corner posts C3 and C4. With this arrangement, mounting member 162 can be placed at any desired elevation within storage cabinet interior 72, and the position of mounting member 162 can be adjusted at any time simply by removing mounting member 162 from one set of key hole openings 218 and engaging mounting member 162 with another set of key hole openings 218 in a desired elevation.

It should also be understood that mounting member 162 may be mounted within storage cabinet interior 72 in a fixed position, or alternatively may be adjustably mounted within storage cabinet interior 72 by any satisfactory adjustable mounting arrangement other than that as shown and described.

Support wall 218 of mounting member 162 includes an upper row of square openings 220 and a lower row of square openings 222. Openings 220 and 222 are laterally spaced at predetermined regular spacing, and extend throughout the majority of the length of mounting member 162. Small circular openings 224 and 226 are located vertically below upper rectangular openings 220 and lower rectangular openings 222, respectively.

Figure 22:
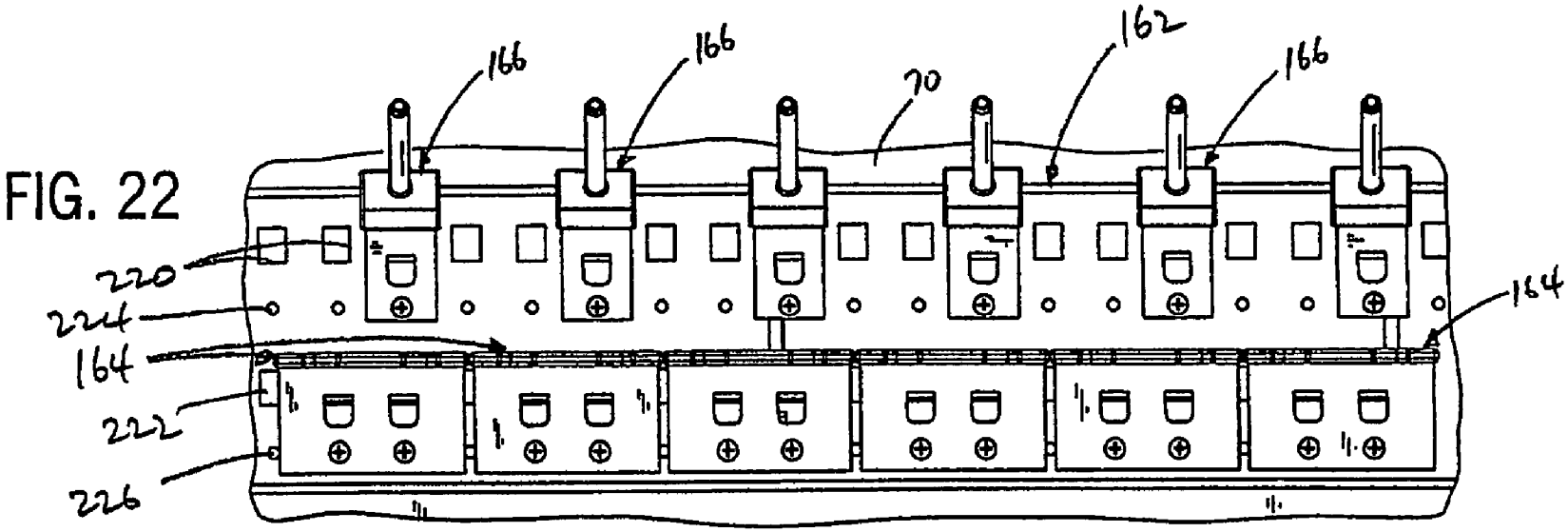
FIG. 22 is a partial elevation view showing a portion of the mounting member of FIG. 21 as well as barrel rest and pistol support components engaged with the mounting member.

Mounting member 162 is employed to support barrel rests such as 164 in a desired elevation within storage cabinet interior 72. As shown in FIGS. 22-24, each barrel rest 164 includes a mounting section 230 and a barrel support section 232. Mounting section 230 is formed with a pair of rearwardly extending engagement lances or tabs 224, which have the same spacing as mounting openings 220, 222 in mounting member 162. Tabs 234 may be formed in a stamping operation from the material of mounting section 230, such that the material of each tab 234 is formed integrally with the material of mounting section 230 at the upper end of each tab 234. In this manner, a downwardly facing space is defined between the forwardly facing surface of each tab 234 and the rearwardly facing surface of mounting section 230. However, it is understood that any other satisfactory method of forming tabs 234 may be employed. In addition, mounting section 230 includes a retainer opening 236 below each mounting tab 234.

Outwardly extending barrel support section 232 includes a body section 238 defining an outwardly facing support edge 240, in combination with a pair of spaced apart support arms 242 that extend outwardly from the opposite sides of support edge 240. The outer area of barrel support section 232 is coated with a resilient material so as to prevent barrel rest 164 from scratching the barrel of the gun that it supports. In this manner, support edge 240 and support arms 242 are coated with the resilient material, so as to present relatively soft surfaces that engage the firearm barrel. The resilient material may be any satisfactory plastic, rubber or other cushioning material, and may be applied to body section 238 in a dipping process or the like.

Barrel rest 164 is engaged at a desired location along the length of mounting member 162 by placing tabs 234 in alignment with a pair of adjacent openings in mounting member 162, such as a pair of lower openings 222. A downward force is then applied to barrel rest 164, such that each tab 234 is moved downwardly along the rearwardly facing surface of support wall 208 until the upper edge of each opening 222 is brought into engagement with the upper extent of tab 234 at its connection to the material of mounting section 230. Barrel rest 164 is disengaged from mounting member 162 by reversing such steps. In this manner, barrel rest 164 may be quickly and easily engaged with and disengaged from mounting member 162, to enable barrel rest 164 to be located in a desired position for use in supporting an upper area of a weapon or firearm. When barrel rest 164 is engaged with mounting member 162 in this manner, retainer openings 236 in mounting section 230 are in alignment with a pair of adjacent retainer openings 226 in mounting member 162. A fastener, such as a screw 244, is engaged within the aligned openings 236, 226, so as to prevent inadvertent removal of barrel rest 164 and to maintain barrel rest 164 in engagement in the desired location on mounting member 162. The configuration of support edge 240 and support arms 242 is particularly designed to cradle the barrel of a certain type of weapon or other firearm that is supported at its lower end by one of the previously described stock rests, such as stock rest 160. FIG. 25 illustrates such operation of stock rest 160 and barrel rest 164, in which barrel B of weapon G1 is engaged with support edge 240 between support arms 242 so as to receive and support weapon barrel B above stock rest 160. Alternatively, the specific configuration of support edge 240 is such that barrel rest 164 may support a scope or bayonet that is separate from or engaged with the firearm, such that barrel rest 164 may be used to support a number of different items within the storage cabinet interior 72.

Figure 26:
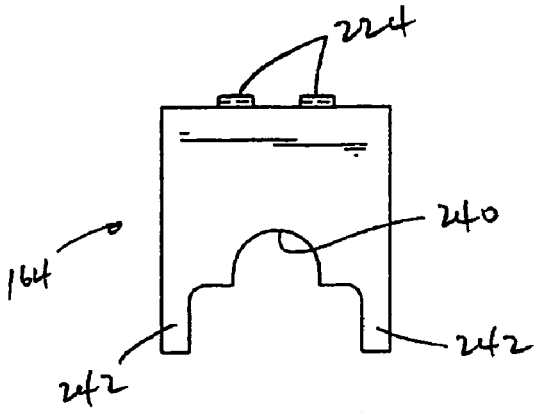
FIGS. 26-29 are top plan views of differently configured barrel rests adapted for use in the cabinet assembly of FIG. 1.
Figure 27:
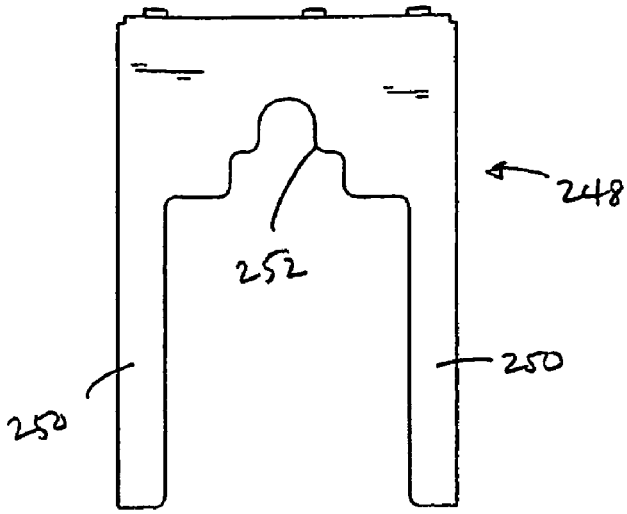
Figure 28:
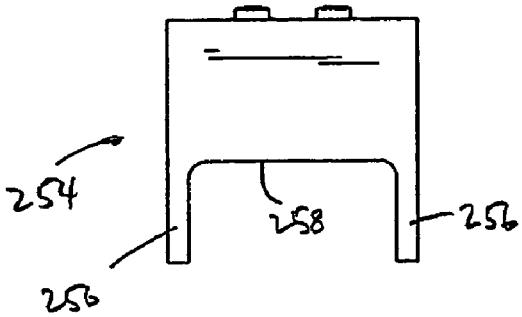
Figure 29:
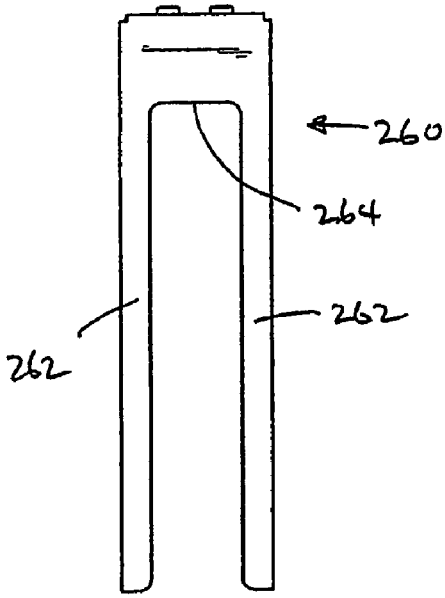

FIGS. 26-29 illustrate differently configured barrel rests that can be engaged with mounting member 162 so as to support the upper end of a weapon or firearm, the lower end of which is supported via engagement with one of the stock rests as described previously. FIG. 26 illustrates the top plan view of barrel rest 164. FIG. 27 illustrates a barrel rest 248 having elongated arms 250 and a body section defining a specially configured support edge 252, for receiving the upper area of a weapon or firearm having a corresponding shape. FIG. 28 illustrates an alternative barrel rest 254, which includes relatively short, narrow arms 256 that cooperate with a support edge 258 to define a recess configured to receive the upper portion of a weapon or firearm having a similar shape. FIG. 29 illustrates yet another barrel rest 260, which includes elongated arms 262 that cooperate with a support edge 264 to define a long, narrow recess configured to receive the upper portion of a weapon or firearm having a similar shape.

It can be appreciated that the barrel rests illustrated in FIGS. 26-29 are illustrative of a wide variety of barrel rest configurations that are possible, with each barrel rest having a shape configured to receive and engage the upper end of a weapon or firearm having a similar shape. It can also be appreciated that rests similar to those as illustrated may be used to support elongated items or equipment other than firearms. In each case, however, the rest includes a mounting section as described previously for engagement with mounting member 162, so as to secure the rest to mounting member 162 within storage cabinet interior 72 above the stock rest. In a preferred system, a barrel test and stock rest combination are selected to be positioned within storage cabinet interior 72, according to the shape and other parameters of the firearms or weapons intended to be contained within the storage cabinet assembly 60.

Referring to FIGS. 22-24, each pistol support 166 includes a mounting section 260 having a mounting lance or tab 262 that extends rearwardly from mounting section 260, and which is formed similarly to mounting tabs 234 of barrel rest mounting section 230. In addition, mounting section 260 includes a retainer opening 264 located vertically below tab 262. Pistol support 166 further includes a support section 266 that extends outwardly from the upper end of mounting section 260, and which includes an angled support plate 268. A support finger 270 is secured at its inner end to support plate 268, and extends outwardly from support plate 268 at an upwardly extending angle. Finger 270 is preferably oriented so as to be perpendicular to support plate 268. A resilient coating 272, such as a plastic, rubber or the like, is applied to finger 270 and to support plate 268, e.g. in a dipping process, to present relatively soft, cushioned outer surfaces of support finger 270 and support plate 268.

Each pistol support 166 may be mounted in any desired location along the length of mounting member 162, by engaging mounting tab 262 within any one of openings 220, 222 in mounting member support wall 208. Each pistol support 166 is secured to mounting member 162 in a manner similar to that of barrel rest 164, by placing the tab 262 within a selected opening and applying a downward force to the pistol support 166 so as to slide mounting tab 262 downwardly along the rearwardly facing surface of support wall 208, until the lower edge of the opening engages the upper end of the mounting tab 262. A fastener, such as a screw 274, is then engaged through retainer opening 264 and the aligned retainer opening 224 or 226 in mounting member 162, to maintain pistol support 166 in position and prevent its inadvertent removal.

In use, a pistol P (FIG. 25) is supported from pistol support 166 by engaging support finger 270 within the barrel of pistol P. In this manner, pistol P is supported such that its butt end faces outwardly, which facilitates quick and easy removal of pistol P from pistol support 166. The resilient coating 272 applied to support finger 270 and support plate 268 prevents scratching or marring of the pistol barrel.

While the invention has been shown and described with respect to engagement of barrel rests and pistol supports with mounting member 162, for use in mounting weapons, accessories and other equipment within the interior of storage cabinet assembly 60, it is understood that such components are illustrative of many different types of support components that may be employed in storage cabinet assembly 60. As to other such components, which may be used to support items of equipment within storage cabinet assembly 60, it is contemplated that the same type of removable engagement system may be employed to mount such components within storage cabinet interior 72, to support any type of weapon, accessory or related equipment.

Referring to FIG. 4, bin assembly 168 may be mounted within storage cabinet interior 72 for storing optics, flashlights, removable stocks or barrels, bayonets, cases, holders, supports or other weapon-related equipment or accessories. Bin assembly 168 includes a pair of bin side walls 278, in combination with a fixed-position bottom shelf 280 to which the lower ends of side walls 278 are secured. Bottom shelf 280 includes front and rear depending support walls 282, 284 (FIG. 16), respectively, which extend downwardly from the front and rear edges, respectively, of bottom shelf 280. Support walls 282, 284 are spaced apart from each other a distance slightly greater than the depth of the stock rests, such as 160, and have a height slightly greater than that of the stock rests. In this manner, bin assembly 168 can be installed over any of the stock rests that may be mounted within the bottom of storage cabinet interior 72, such that support walls 282, 284 enable bin assembly 168 to bridge over the underlying portion of the stock rest. Alternatively, the stock rest may be formed so as to have a length that extends only to the side of bin assembly 168, since the portion of the stock rest located below the bin assembly 168 is unusable.

In a representative construction, each support wall 282, 284 may have a flange at its lower end, with openings that are adapted to be positioned in alignment with selected ones of horizontal base wall openings 178. Screws or other satisfactory fasteners may be engaged within the aligned openings, to secure the lower end of bin assembly 168 in position within storage unit interior 72. Alternatively, support walls 282, 284 may be formed with tabs that extend through the slotted portions of base wall openings 178.

Referring to FIG. 8, the upper end of each bin side wall 278 is formed with a flange 286, which is adapted to be positioned adjacent the downwardly facing surface of top panel 96. Flanges 286 have openings that are adapted to be placed into alignment with openings such as 288 in top panel 96, and screws or other satisfactory fasteners are engaged within the aligned openings to secure the upper end of bin assembly 168 in position within storage cabinet interior 72. It is understood that this mounting arrangement is illustrative, and that any other type of satisfactory mounting arrangement may be employed for securing the upper end of bin assembly 168 in position.

Figure 18:
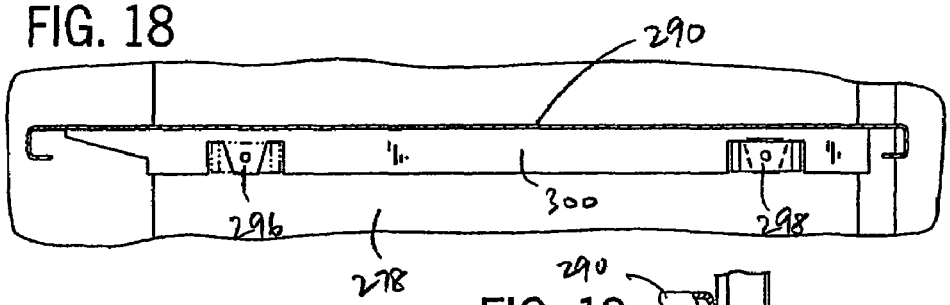
FIG. 18 is a partial section view taken along line 18-18 of FIG. 17.
Figure 19:
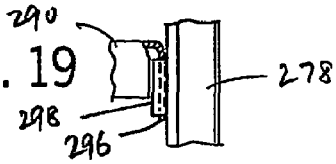
FIG. 19 is a partial section view taken along line 19-19 of FIG. 17.

A series of shelves 290 are adapted to be engaged with and span between bin assembly side walls 278 above bottom shelf 280. Preferably, the position of each shelf 290 can be adjusted along the height of the side walls 278. To accomplish this, each side wall 278 includes a series of vertically spaced front shelf mounting members 292 and a series of vertically spaced rear shelf mounting members 294, as shown in FIGS. 18 and 19. Representatively, shelf mounting members 292, 294 may be formed in a stamping operation from an inwardly deformed portion of the material of side wall 278, with open areas located above and below each shelf mounting member. Each shelf 290 includes a front mounting ear 296 on each of its sides and a rear mounting ear 298 on each of its sides. In the illustrated embodiment, each shelf 290 includes a pair of side flanges, and mounting ears 296, 298 are formed from a portion of the material of each side flange 300. Mounting ears 296, 298 have a configuration adapted to be engaged with front and rear shelf mounting members 292, 294, respectively. With this construction, each shelf 290 is engaged with bin assembly side walls 278 by positioning mounting ears 296, 298 vertically above shelf mounting members 292, 294, respectively, and applying a downward force to the shelf 290 so as to engage the mounting ears 296, 298 with the respective shelf mounting members 292, 294. Any desired number of shelves can be engaged with side walls 278 in any position along the height of side walls 278, according to the dimensions and configuration of the items adapted to be supported by the shelves 290.

Figure 41:
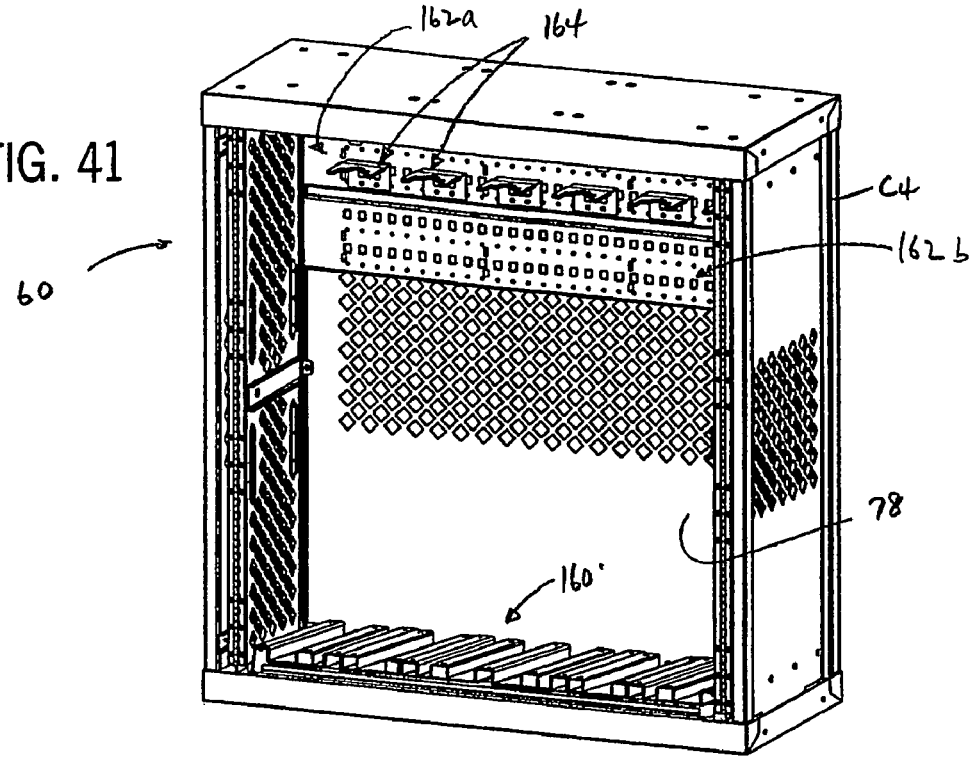
FIGS. 41-55 are isometric views showing different configurations of components, modules and accessories adapted to be mounted within the interior of the storage cabinet assembly of FIG. 1.

FIGS. 41-55 contain representations of various illustrative configurations of components that can be mounted within storage cabinet interior 72, according to the items intended to be contained within the storage cabinet assembly 60. In FIG. 41, storage cabinet interior 72 is illustrated as being outfitted with a stock rest 160', which has a configuration somewhat similar to stock rest 160. An upper mounting member 162*a* is secured between corner posts C3 and C4 in an upper position within storage cabinet interior 72, and barrel rests 164 are secured to mounting member 162*a* at desired locations along the length of mounting member 162*a*, to support the barrels of firearms having stocks that are supported by stock rest 160'. An additional lower mounting member 162*b* is located below the upper mounting member 162*a*, and may be used to secure pistol supports or any other storage components within storage cabinet interior 72.

Figure 42:
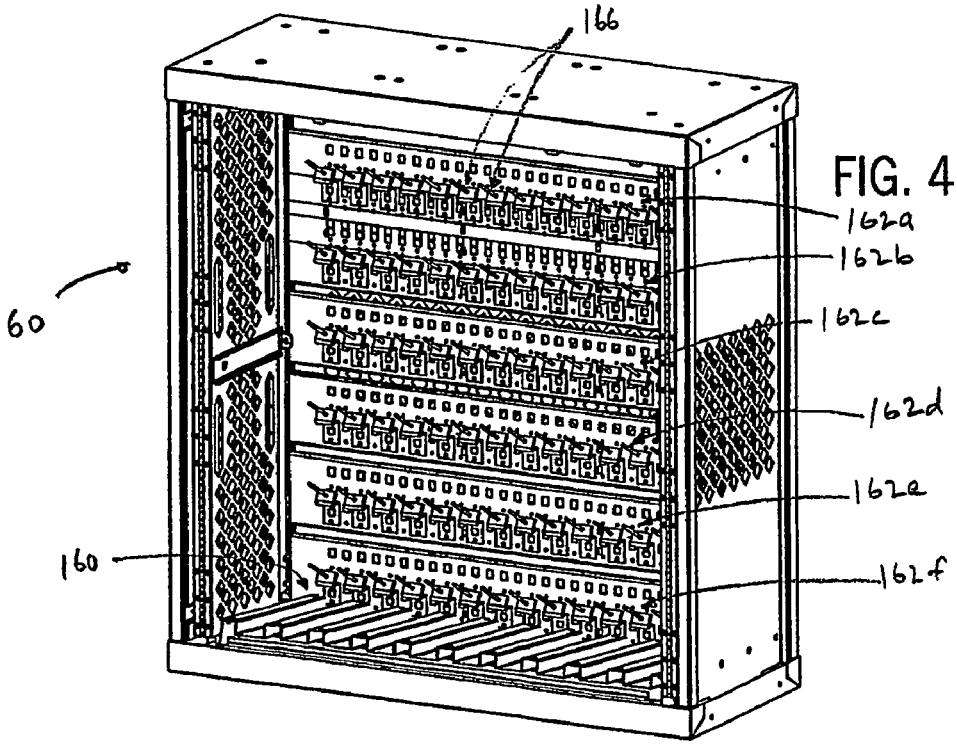

FIG. 42 illustrates a configuration in which horizontally extending, vertically spaced rows of pistol supports 166 are secured to each of a series of mounting members 162*a*, 162*b*, 162*c*, 162*d*, 162*e* and 162*f*. In this embodiment, storage cabinet assembly 60 includes stock rest 160, so as to enable the storage cabinet assembly to be used to store rifles or other firearms by removing certain of pistol supports 166 and installing one or more barrel rests in desired locations to one or more of mounting members 162*a*-162*f*.

Figure 43:
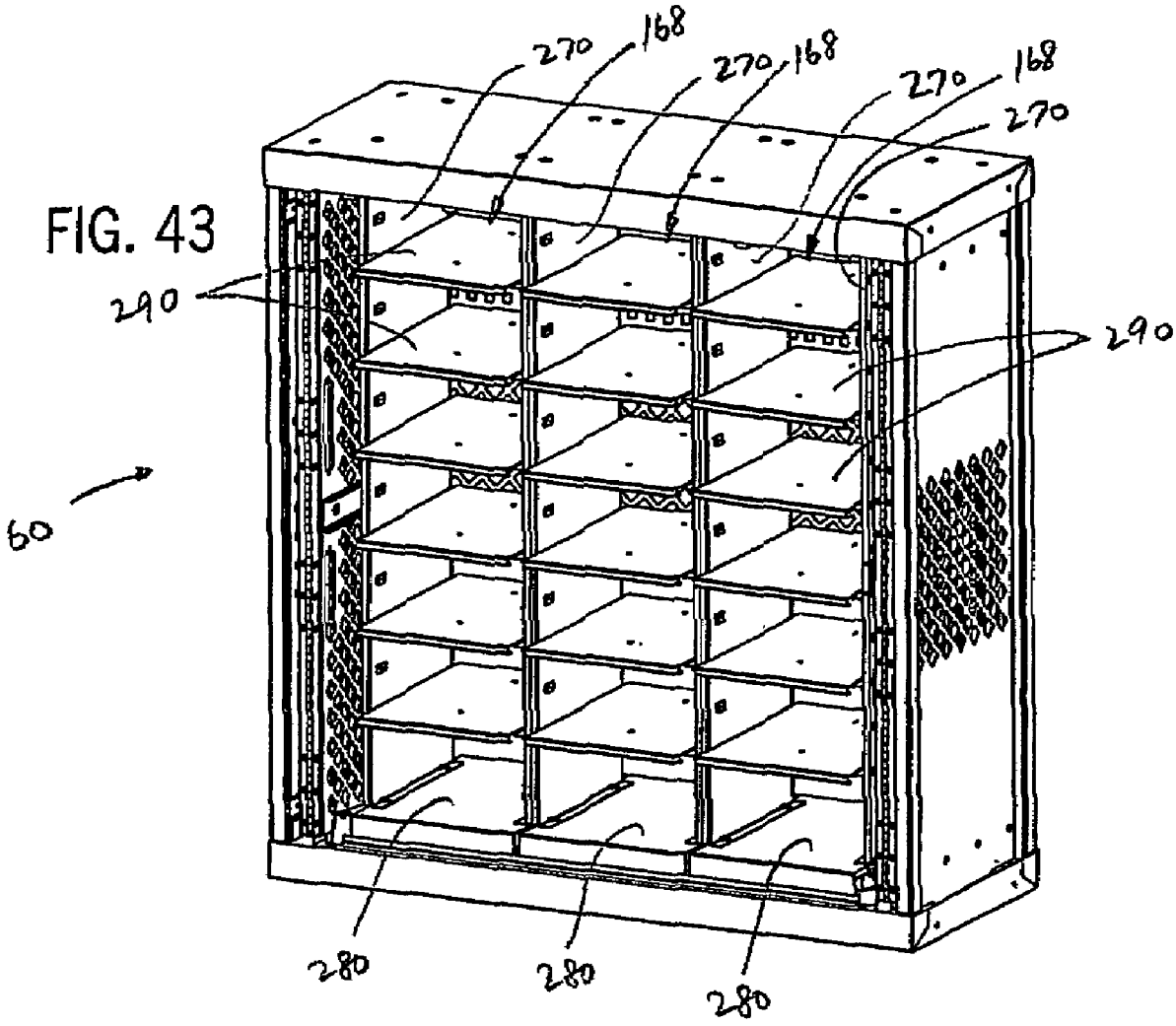

FIG. 43 illustrates a configuration in which a series of bin assemblies 168 are mounted side-by-side within storage cabinet interior 72, to occupy substantially the entire volume of storage cabinet interior 178.

Figure 44:
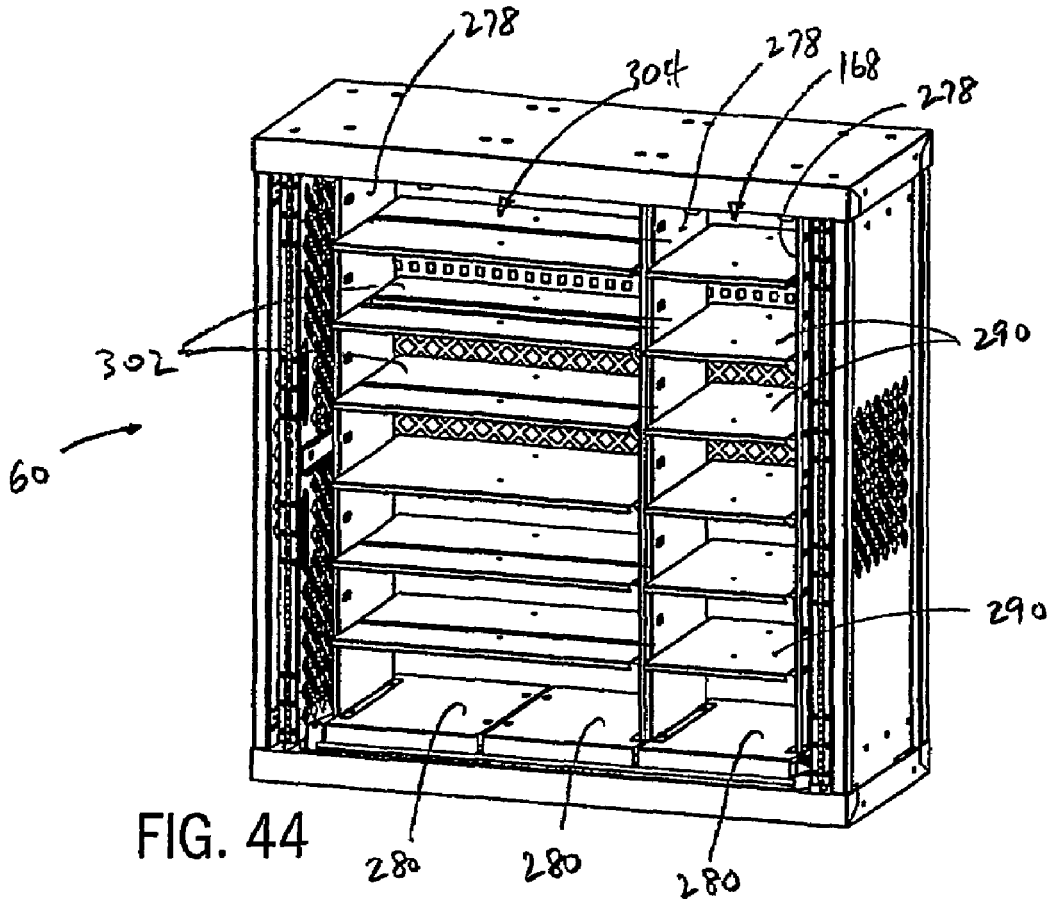

FIG. 44 illustrates a configuration in which one bin assembly 168 is mounted to one side of storage cabinet interior 178. The remainder of the volume of storage cabinet interior 72 is occupied by a modified bin assembly 302, which consists of a pair of shelf side walls 278 and bottom shelves 280, secured within storage cabinet interior 72 in the same manner as described previously. Modified elongated shelves 304 are secured between the shelf side walls 278, and are mounted to shelf side walls 278 in the same manner as described above.

Figure 45:
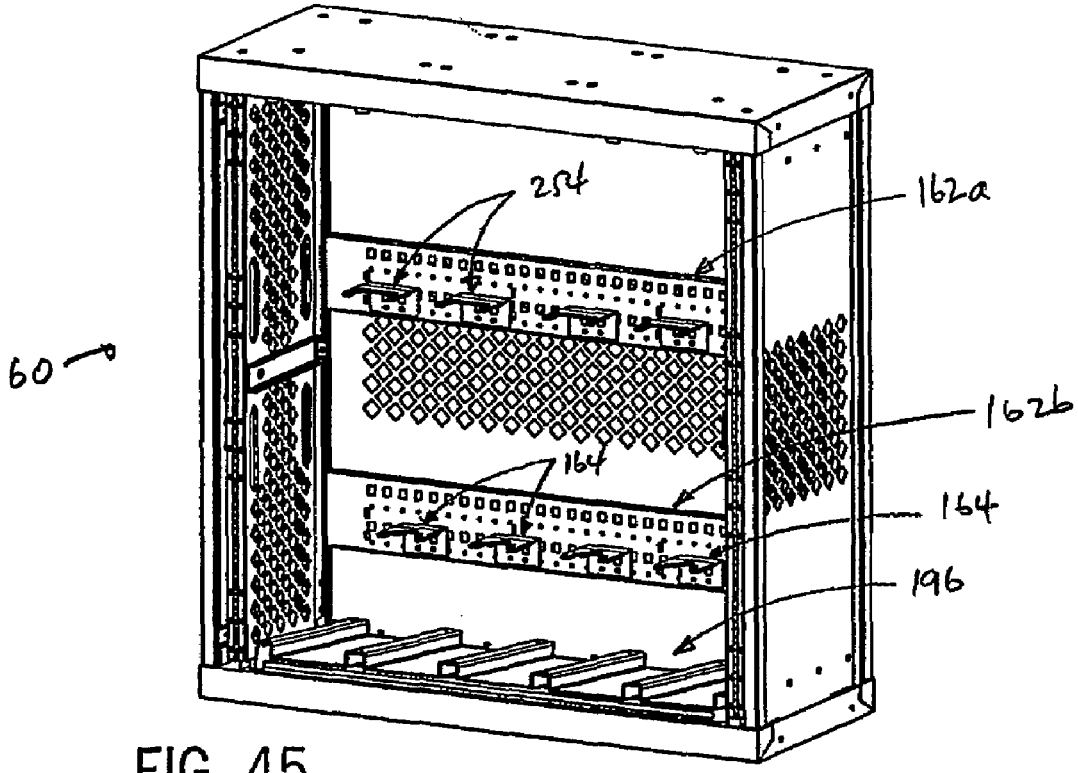

FIG. 45 illustrates a configuration in which stock rest 196 is secured in the bottom of storage cabinet interior 72. An upper mounting member 162*a* is employed to secure barrel rests 254, each of which is in alignment with one of the channels or troughs defined by stock rest 196. A lower mounting member 162*b* is mounted within storage cabinet interior 72 between stock rest 196 and upper mounting member 162*a*. A series of barrel rests 164 are mounted to lower mounting member 162*b*. In this configuration, a weapon such as a machine gun is supported by stock rest 196 in combination with each of barrel rests 254. A bayonet or scope associated with the weapon is engaged at its lower end with one of the openings in the stock rest channel or trough, and is supported thereabove by engagement within the recess defined by support edge 240 of barrel rest 164.

Figure 46:
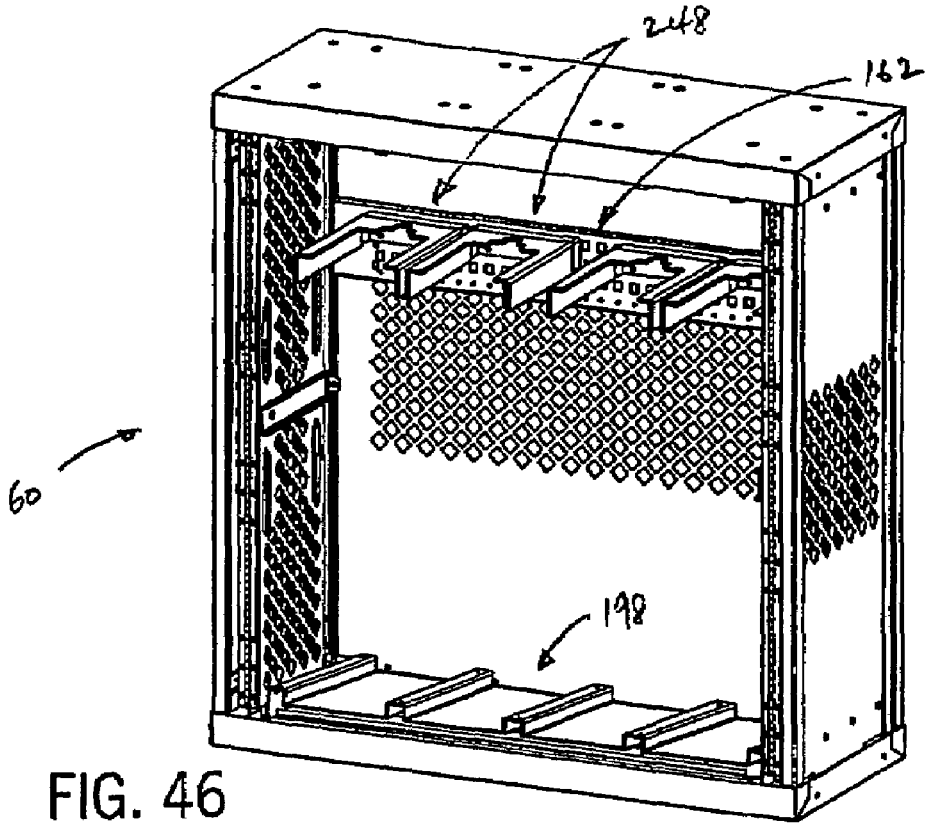

FIG. 46 illustrates a configuration in which stock rest 198 is mounted in the bottom of storage cabinet interior 72. A mounting member 162 is utilized to mount a series of barrel rests 248, each of which is in alignment with one of the channels or troughs defined by stock rest 198.

Figure 47:
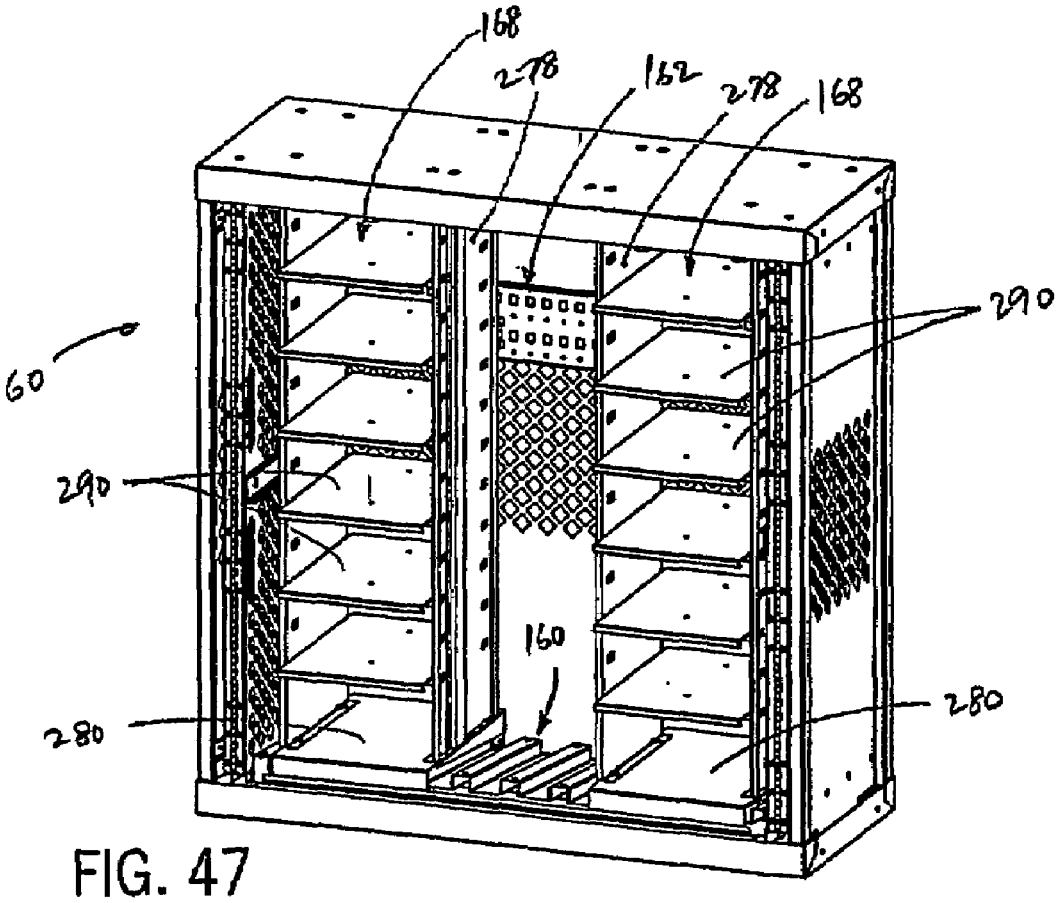

FIG. 47 illustrates a configuration in which a pair of bin assemblies 168 are mounted in each side of storage cabinet interior 72. An open space is defined between the bin assemblies 168, so as to expose a portion of stock rest 160 that may be utilized to store rifles or other firearms between bin assemblies 168. Suitable barrel rests are secured to mounting member 162 between bin assemblies 168, so as to accommodate the rifles or other firearms.

Figure 48:
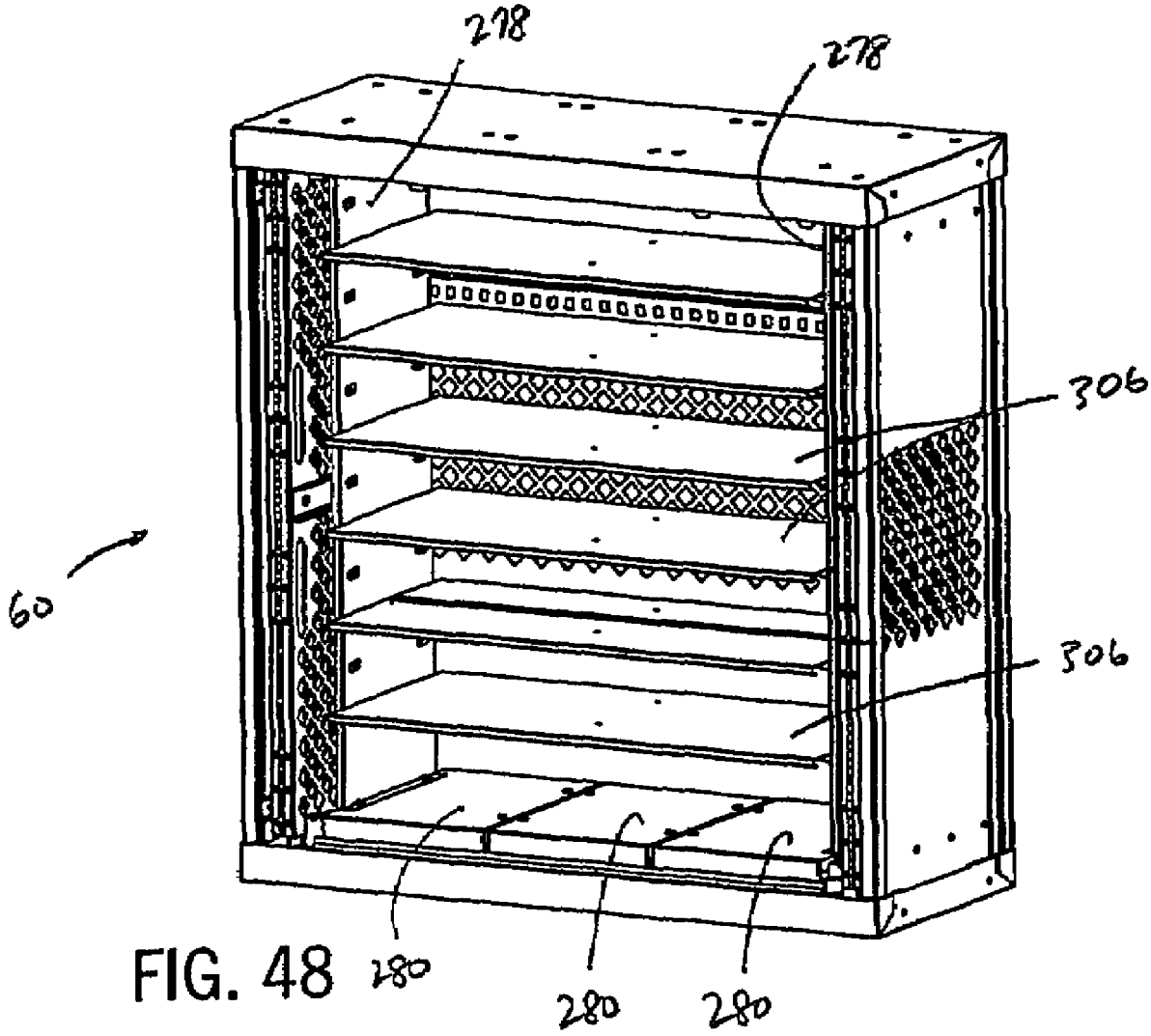

FIG. 48 illustrates a configuration in which wide, open shelves are contained within storage cabinet interior 72. In this configuration, bin assembly side walls 278 are mounted to opposite sides of storage cabinet interior 278, in the same manner described previously with respect to bin assembly 168. Three bottom shelves 28Q are mounted in the bottom of storage cabinet interior 72. Modified elongated shelves 306 extend between shelf side walls 278, and are interconnected therewith in the same manner as described previously with respect to bin assembly 168.

Figure 49:
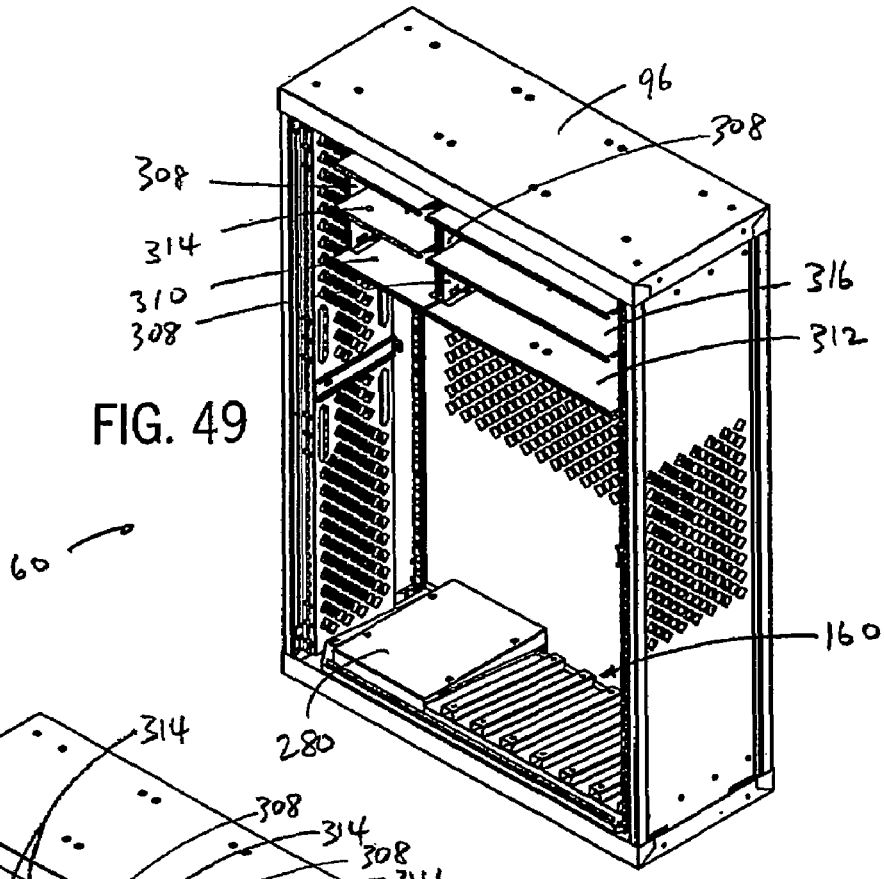

FIG. 49 illustrates a configuration in which a portion of stock rest 160 is exposed for use in supporting rifles or other elongated firearms, with the remainder of the stock rest 160 being covered by a bottom shelf 280. Upper shelves are contained within the top portion of storage cabinet 62. The upper shelves include vertical shelf walls 308, which are secured to top panel 96 in the same manner described previously with respect to shelf side walls 278. Each shelf wall 308 includes a flange at its lower end, which is secured to a bottom shelf member such as 310, 312, which in turn are supported via a mounting member 162 to which a series of shelf support brackets 318 (FIG. 51) are mounted. Intermediate shelves 314, 316 are secured to shelf walls 308, in the same manner as described previously with respect to shelves 290 of bin assembly 168.

Figure 50:
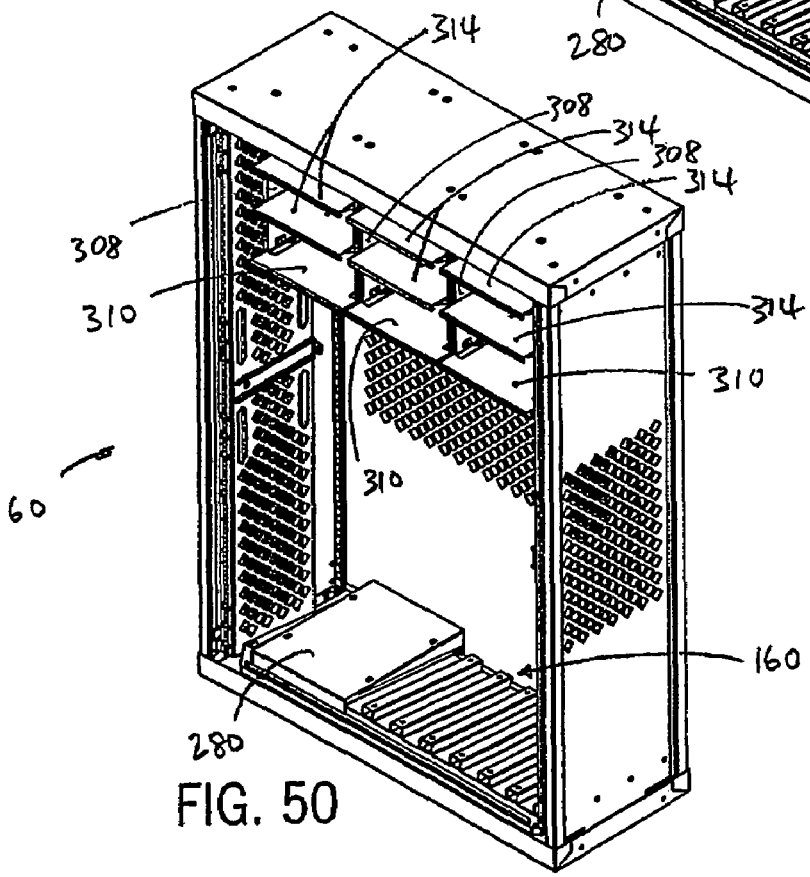

FIG. 50 illustrates a configuration similar to that of FIG. 49. In this configuration, a series of shelf walls 308 support shelf members 314 in a side-by-side manner.

Figure 51:
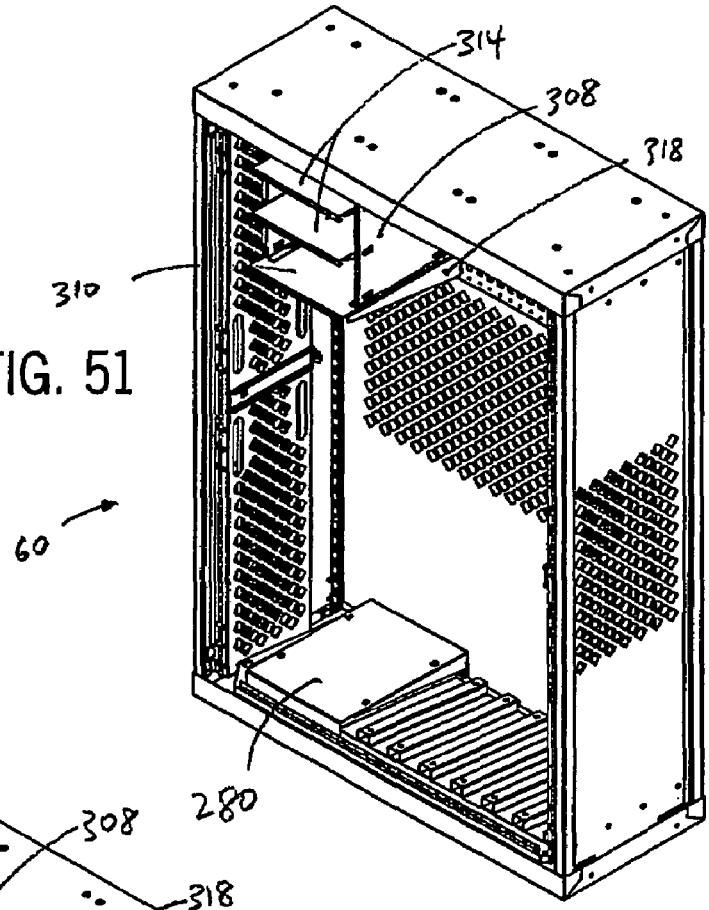

FIG. 51 illustrates a configuration similar to that of FIG. 50. In this configuration, a single shelf module is contained in the upper portion of storage cabinet assembly 60. Lower shelf 310 is supported by a pair of mounting brackets 318, which are configured for engagement with mounting member 162 in the same manner as described previously. Shelf walls 308 are engaged with lower shelf 310, and intermediate shelves 314 are engaged with shelf walls 308 above lower shelf 310.

Figure 52:
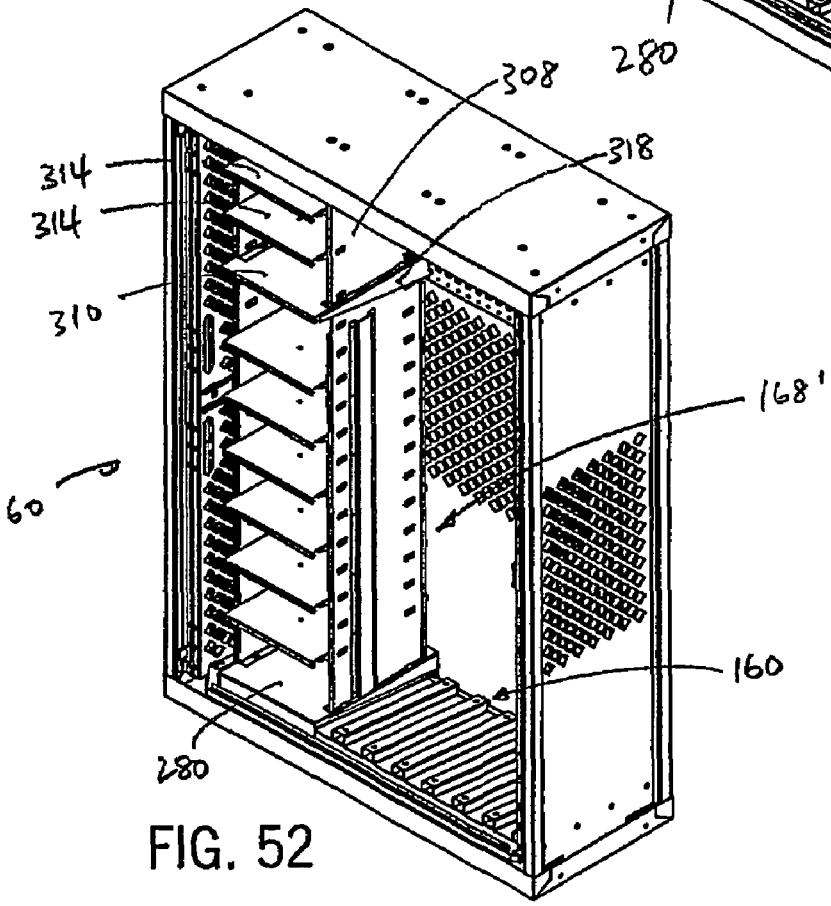

FIG. 52 illustrates a configuration in which a shelf module as in FIG. 51 is combined with a bin assembly 168', which is configured similarly to bin 168 but is mounted at its upper end to shelf member 310 instead of being mounted to the underside of top panel 96, as described previously.

Figure 53:
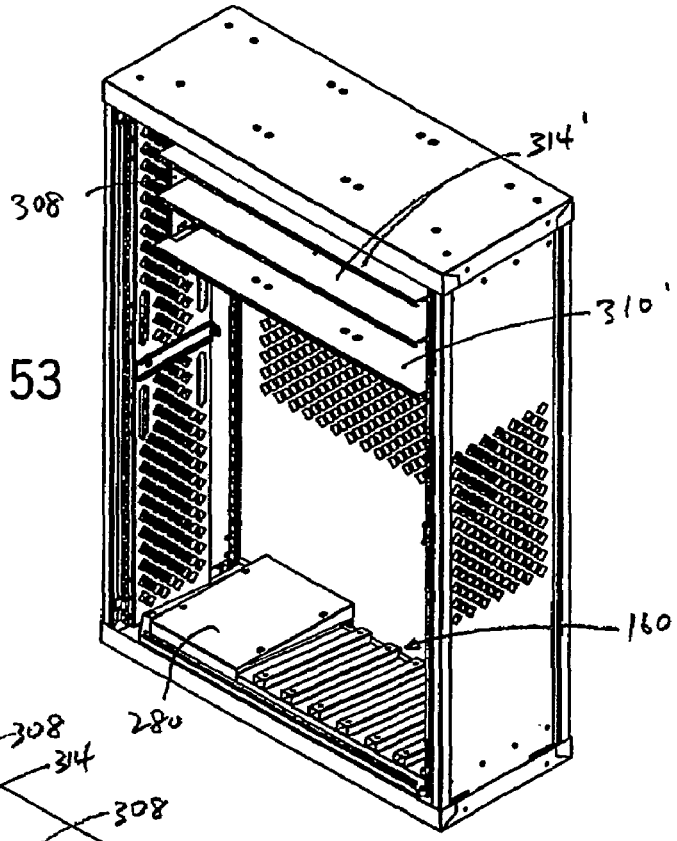

FIG. 53 illustrates a configuration in which an elongated lower shelf member 310' is engaged with shelf walls 308, which are secured to a mounting member 162 as described previously via a bracket arrangement. Intermediate shelves 310' are engaged with shelf walls 308 above lower shelf 310'.

Figure 54:
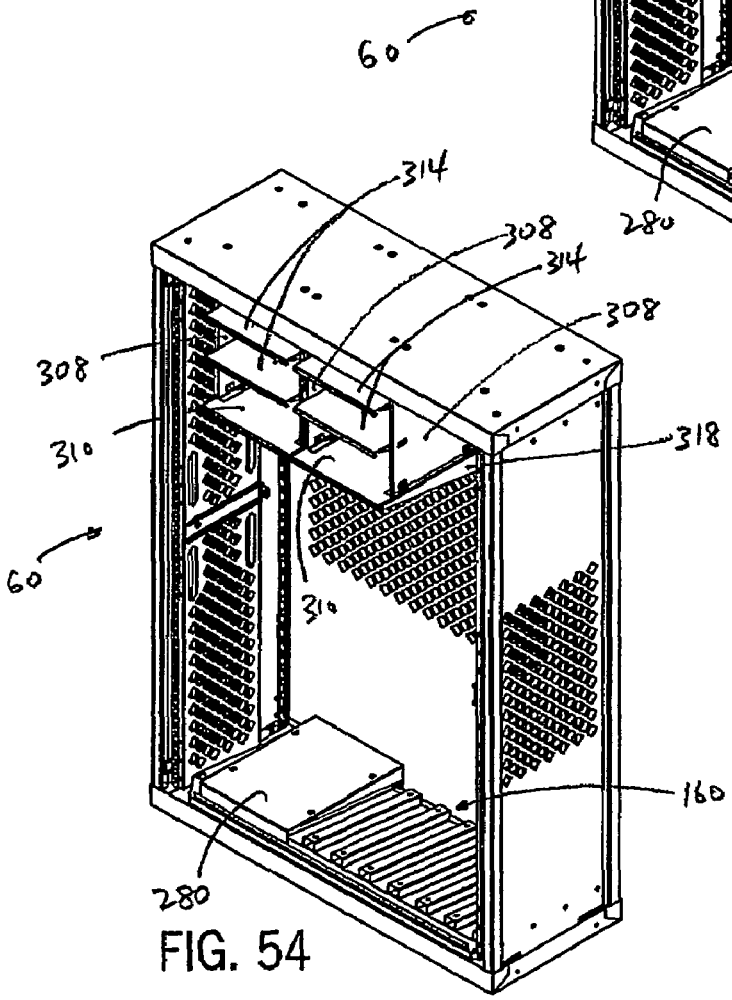

FIG. 54 illustrates a similar configuration, in which a pair of shelf modules, similar to those illustrated in FIG. 51, are contained within the upper extent of storage cabinet interior 72.

Figure 55:
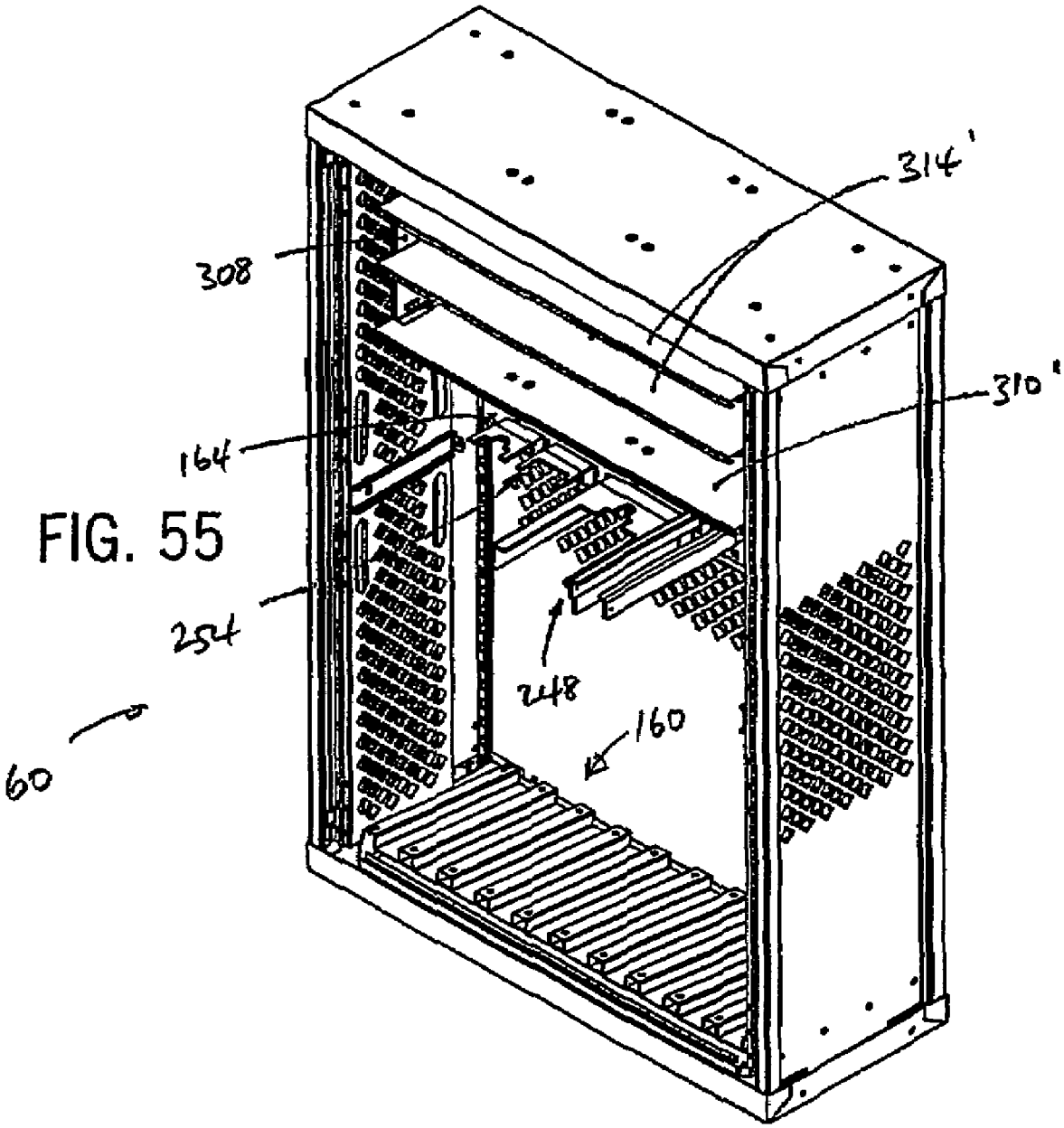

FIG. 55 illustrates yet another alternative configuration, in which a shelf arrangement as shown in FIG. 53 is combined with a series of barrel rests that are secured to a mounting member located below the shelf assembly, to support weapons or other firearms therebelow in combination with stock rest 160.

It can thus be appreciated that the present invention provides a shelf system which can be uniquely configured and reconfigured according to user requirements, simply by positioning or repositioning certain components within the storage cabinet interior 72. Such arrangement and rearrangement of the components may take place during initial manufacture, or on site or at any other location where it is desired to alter the storage cabinet configuration. The various components can be installed and removed using only a screwdriver, which facilitates quick and easy installation and removal.

Various alternatives and embodiments are contemplated as being within the scope of the following claims particularly pointing out and distinctly claiming the subject matter regarded as the invention.

We claim

1. A storage cabinet assembly, comprising:

a cabinet defining an interior;

a folding door arrangement mounted to the cabinet, wherein the folding door arrangement includes a pair of folding door sections, each of which includes an inner door member and outer door member, wherein the folding door sections are movable between a closed position in which the folding door sections cooperate to prevent access to the cabinet interior, and an open position in which the folding door sections are positioned to provide access to the cabinet interior, wherein the inner door members of the folding door sections are located adjacent each other when the folding door sections are in the closed position; and a locking arrangement associated with the folding door arrangement, wherein the locking arrangement includes a latch member carried by each of the folding door sections, wherein each latch member is movable between an engaged position and a release position, wherein each latch member in the engaged position maintains its associated door section in the closed position and wherein each latch member in the release position enables movement of its associated door section between the closed position and the open position, and wherein the locking arrangement further includes a movable control member carried by each door section, wherein each control member is interconnected with one of the latch members and wherein each control member is movable between a raised first position in which the control member places its associated latch member in the engaged position, and a lowered second position in which the control member places its associated latch member in the release position, wherein the control members in the first position overlie the inner door members, and wherein the locking arrangement further includes a lock that is engageable with the control members to secure the control members together to maintain the door sections in the closed position and the latch members in the engaged position, wherein each control member is pivotably movable between the raised first position and the lowered second position about a generally horizontal axis, and wherein the control members are gravity biased toward the lowered second position so as to be movable from the raised first position to the lowered second position under the influence of gravity when the lock is disengaged from the control members.

2. The storage cabinet assembly of claim 1, wherein each latch member includes an upper section and a lower section, each of which is secured to a cam member carried by one of the door sections, wherein each control member is connected to one of the cam members and wherein movement of the control member from the lowered second position to the raised first position is operable to actuate the cam member to move the upper section of the latch member upwardly and the lower section of the latch member downwardly to position the latch member in the engaged position.

3. The storage cabinet assembly of claim 2, wherein each cam member is pivotably mounted to one of the door sections such that movement of the control member between the first and second positions causes pivoting movement of the cam member to move each latch member between the engaged and disengaged positions.

4. The storage cabinet assembly of claim 1, wherein the control members are configured to define end areas that are located adjacent each other when the control members are in the raised first position, and wherein the end areas of the control members are adapted to be secured together by the lock to maintain the door sections in the closed position.

5. The storage cabinet assembly of claim 4, wherein the end area of each control member defines an opening, wherein the openings in the end areas of the control members are located adjacent each other when the control members are in the first position, and wherein the lock is configured to extend through the control member openings, wherein the lock is adapted to prevent movement of the control members away from the first position to maintain the door sections in the closed position.

6. The storage cabinet assembly of claim 1, wherein the cabinet and the door sections include a cooperating guide arrangement for guiding movement of the door sections between the open and closed positions.

7. The storage cabinet assembly of claim 6, wherein the cooperating guide arrangement includes a track arrangement associated with the cabinet and one or more rollers associated with each door section and engaged with the track arrangement.

8. The storage cabinet assembly of claim 6, wherein the cabinet includes a pair of sidewalls, and wherein the door members of each door section are folded together when the door section is in the open position, and further comprising a slide arrangement interconnected with each door section for enabling movement of each door section to a recessed position adjacent one of the cabinet sidewalls when the door section is in the open position and the door sections are folded together.

9. The storage cabinet assembly of claim 1, further comprising a plurality of differently configured storage modules, wherein the storage modules are adapted to be mounted within the cabinet interior.

10. The storage cabinet assembly of claim 9, wherein a set of storage modules are selected from the plurality of differently configured storage modules and are mounted to the cabinet within the cabinet interior, and wherein at least selected ones of the storage modules comprise firearm storage modules that are configured to support and store firearms.

11. The storage cabinet assembly of claim 10, wherein the firearm storage modules include one or more stock rests, one or more barrel rests, and a pistol support.

12. The storage cabinet assembly of claim 1, wherein the inner and outer door members include a plurality of perforations for providing ventilation and visual access to the interior of the cabinet, wherein the perforations include one or more slots, each of which is configured to provide a hand grip area to facilitate movement of the door sections between the closed and open positions.

13. The storage cabinet assembly of claim 12, wherein the slots are oriented generally vertically.

14. The storage cabinet assembly of claim 13, wherein each door section includes a pair of spaced apart side edges, and wherein the slots are located adjacent the edges of the door sections.

15. The storage cabinet assembly of claim 13, wherein at least a pair of the slots are vertically offset from each other, and wherein one of the control members is located between the vertically offset slots.

16. A storage cabinet assembly, comprising:

a cabinet defining an interior;

a folding door arrangement mounted to the cabinet, wherein the folding door arrangement includes a pair of folding door sections, each of which includes an inner door member and an outer door member, wherein the folding door sections are movable between a closed position in which the folding door sections cooperate to prevent access to the cabinet interior, and an open position in which the folding door sections are positioned to provide access to the cabinet interior, wherein the inner door members of the folding door sections define inner edges that are located adjacent each other when the folding door sections are in the closed position;

wherein the inner and outer door sections include a plurality of perforations for providing ventilation and visual access to the interior of the cabinet, wherein the perforations include one or more slots, each of which is configured to provide a hand grip area to facilitate movement of the door sections between the closed and open positions; and a locking arrangement associated with the folding door arrangement, wherein the locking arrangement includes a latch member carried by each of the folding door sections, wherein each latch member is movable between an engaged position and a release position, wherein each latch member in the engaged position maintains its associated door section in the closed position and wherein each latch member in the release position enables movement of its associated door section between the closed position and the open position, and wherein the locking arrangement further includes a movable control member carried by each door section, wherein each control member is interconnected with one of the latch members and wherein each control member is movable between a raised first position in which the control member places its associated latch member in the engaged position, and a lowered second position in which the control member places its associated latch member in the release position, wherein the control members in the first position overlie the inner door members, and wherein the locking arrangement further includes a lock that is engageable with the control members to secure the control members together to maintain the door sections in the closed position and the latch members in the engaged positions;

wherein each control member is pivotably movable between the raised first position and the lowered second position about a generally horizontal axis, and wherein the control members are gravity biased toward the lowered second position so as to be movable from the raised first position to the lowered second position under the influence of gravity when the lock is disengaged from the control members.

17. The storage cabinet assembly of claim 16, wherein the slots are oriented generally vertically.

18. The storage cabinet assembly of claim 17, wherein each door section includes a pair of spaced apart side edges, and wherein the slots are located adjacent the edges of the door sections.

19. The storage cabinet assembly of claim 17, wherein at least a pair of the slots are vertically offset from each other, and wherein one of the control members is located between the vertically offset slots.

20. The storage cabinet assembly of claim 16, wherein each latch member includes an upper section and a lower section, each of which is secured to a cam member carried by one of the door sections, wherein each control member is connected to one of the cam members and wherein movement of the control member is operable to actuate the cam member to move the upper section of the latch member upwardly and the lower section of the latch member downwardly to position the latch member in the engaged position.

21. The storage cabinet assembly of claim 20, wherein each cam member is pivotably mounted to one of the door sections such that movement of the associated control member between the first and second positions causes pivoting movement of the cam member to move each latch member between the engaged and disengaged positions.

22. The storage cabinet assembly of claim 16, wherein the control members are configured to define end areas that are located adjacent each other when the control members are in the first position, and wherein the end areas of the control members are adapted to be secured together to maintain the door sections in the closed position.

23. The storage cabinet assembly of claim 22, wherein the end area of each control member defines an opening, wherein the openings in the end areas of the control members are located adjacent each other when the control members are in the first position, and wherein the lock is configured to extend through the control member openings, wherein the lock is adapted to prevent movement of the control members away from the first position and to thereby prevent movement of the door sections away from the closed position.

24. The storage cabinet assembly of claim 16, wherein the cabinet and the door sections include a cooperating guide arrangement for guiding movement of the door sections between the open and closed positions.

25. The storage cabinet assembly of claim 24, wherein the cooperating guide arrangement includes a track arrangement associated with the cabinet and one or more rollers associated with each door section and engaged with the track arrangement.

26. The storage cabinet assembly of claim 24, wherein the cabinet includes a pair of sidewalls, and wherein the door members of each door section are folded together when the door section is in the open position, and further comprising a slide arrangement interconnected with each door section for enabling movement of each door section to a recessed position adjacent one of the cabinet sidewalls when the door section is in the open position and the door sections are folded together.

27. The storage cabinet assembly of claim 16, further comprising a plurality of differently configured storage modules, wherein the storage modules are adapted to be mounted within the cabinet interior.

28. The storage cabinet assembly of claim 27, wherein a set of storage modules are selected from the plurality of differently configured storage modules and are mounted to the cabinet within the cabinet interior, and wherein at least selected ones of the storage modules comprise firearm storage modules that are configured to support and store firearms.

29. The storage cabinet assembly of claim 28, wherein the firearm storage modules include one or more stock rests, one or more barrel rests, and a pistol support.

* * * * *